US010202774B2

(12) United States Patent
Jay et al.

(10) Patent No.: US 10,202,774 B2
(45) Date of Patent: Feb. 12, 2019

(54) FITTING EXTERNAL INSULATION SYSTEMS TO BUILDINGS

(71) Applicant: B R TESTING LIMITED, Blackburn (GB)

(72) Inventors: Daniel Adam Jay, Elland (GB); Richard Matthew Ratcliff, Preston (GB)

(73) Assignee: B R TESTING LIMITED, Blackburn (GB)

( * ) Notice: Subject to any disclaimer, the term of this patent is extended or adjusted under 35 U.S.C. 154(b) by 0 days.

(21) Appl. No.: 15/567,313

(22) PCT Filed: Apr. 15, 2016

(86) PCT No.: PCT/GB2016/051051
§ 371 (c)(1),
(2) Date: Oct. 17, 2017

(87) PCT Pub. No.: WO2016/166545
PCT Pub. Date: Oct. 20, 2016

(65) Prior Publication Data

US 2018/0106049 A1 Apr. 19, 2018

(30) Foreign Application Priority Data

Apr. 17, 2015 (GB) ..... 1506538.6
Oct. 21, 2015 (GB) ..... 1518677.8
Jan. 27, 2016 (GB) ..... 1601499.5

(51) Int. Cl.
*E04F 13/08* (2006.01)
*E04B 1/76* (2006.01)
*E04F 21/08* (2006.01)

(52) U.S. Cl.
CPC ..... *E04F 13/0807* (2013.01); *E04B 1/7629* (2013.01); *E04F 21/085* (2013.01)

(58) Field of Classification Search
CPC .... E04F 13/0807; E04F 21/085; E04B 1/7629
See application file for complete search history.

(56) References Cited

U.S. PATENT DOCUMENTS 3,127,703 A * 4/1964 Eshelman ..... E04F 21/05 52/365
4,040,222 A * 8/1977 Cull ..... E04F 13/0853 52/365

(Continued)

FOREIGN PATENT DOCUMENTS

CA 2153293 C 1/1999
CN 101514571 A 8/2009

(Continued)

OTHER PUBLICATIONS

Search Report for GB Patent Application No. 1518677.8, dated Mar. 16, 2016 (2 pages).

(Continued)

*Primary Examiner* — Adriana Figueroa
(74) *Attorney, Agent, or Firm* — Hamre, Schumann, Mueller & Larson, P.C.

(57) ABSTRACT

There is disclosed a method of retro-fitting an external insulation system to a building, and a retro-fit external insulation system for a building. One disclosed method comprising the steps of: mounting a plurality of support elements (16) to an existing external surface (14) of a wall (12) of a building (10); providing a plurality of surface panels (22), each of which comprises an internal wall-facing surface (36) and an external surface (38); arranging the surface panels so that they cover at least a substantial part of the existing external surface of the wall; mounting each surface panel to one or more of the support elements, so that cavities (40) are defined between the internal wall-facing surfaces of the panels and the existing external surface of the wall; and supplying flowable insulation material (42) into (Continued)

the cavities; in which the step of mounting the support elements to the external surface comprises positioning at least one adjustable one-piece spacer (108) between each support element and the surface, the spacer comprising a first end (112) which abuts the surface and a second end (114) which abuts the support element, and adjusting the spacer to vary a space (110) between the support element and the surface.

28 Claims, 12 Drawing Sheets

(56) References Cited

U.S. PATENT DOCUMENTS

| | | | | | |
|---|---|---|---|---|---|
| 4,277,926 | A * | 7/1981 | Sherman | E04B 1/76 52/302.3 |
| 4,334,394 | A | 6/1982 | Mader | |
| 4,360,993 | A * | 11/1982 | Tomokazu | E04F 13/0807 52/365 |
| 4,495,741 | A | 1/1985 | Pasiecznik | |
| 5,287,674 | A | 2/1994 | Sperber | |
| 5,365,716 | A | 11/1994 | Munson | |
| 5,685,124 | A | 11/1997 | Jandl, Jr. | |
| 6,355,333 | B1 | 3/2002 | Waggoner et al. | |
| 9,856,655 | B2 * | 1/2018 | Knight | E04F 13/0862 |
| 2005/0247021 | A1 | 11/2005 | Schauffele | |
| 2007/0084139 | A1 | 4/2007 | Stender | |
| 2007/0204541 | A1 | 9/2007 | Sade | |
| 2012/0279156 | A1 | 11/2012 | Winteler | |
| 2013/0263540 | A1 * | 10/2013 | Riggs | E04B 1/7038 52/302.1 |

FOREIGN PATENT DOCUMENTS

| | | | | |
|---|---|---|---|---|
| CN | 201794191 | U | 4/2011 | |
| CN | 202936979 | U | 5/2013 | |
| CN | 203412126 | U | 1/2014 | |
| CN | 203834792 | U | 9/2014 | |
| DE | 1683201 | A1 * | 12/1969 | E04F 13/0807 |
| DE | 2460930 | A1 * | 7/1976 | A47B 96/07 |
| DE | 3127736 | A1 * | 2/1983 | E04F 13/0807 |
| DE | 3203534 | A | 9/1983 | |
| DE | 3203534 | A1 | 9/1983 | |
| DE | 3502959 | A1 * | 7/1986 | E04F 13/0807 |
| DE | 4006242 | A1 * | 8/1991 | E04F 13/0807 |
| DE | 4220071 | A | 12/1993 | |
| DE | 4419589 | A1 * | 10/1994 | E04F 13/0807 |
| DE | 29619715 | U1 | 1/1997 | |
| DE | 29619715 | U | 2/1997 | |
| DE | 19705202 | A1 * | 8/1998 | E04F 13/0807 |
| DE | 202006000604 | U | 5/2006 | |
| DE | 102007016236 | B | 10/2008 | |
| EP | 0811773 | A2 * | 12/1997 | E04B 1/762 |
| FR | 2152423 | A1 * | 4/1973 | E04F 13/0807 |
| FR | 2533959 | A * | 4/1984 | |
| FR | 2533959 | A | 4/1984 | |
| FR | 2965828 | A | 4/2012 | |
| FR | 2965828 | A1 | 4/2012 | |
| GB | 2155968 | A | 10/1985 | |
| GB | 2257246 | A | 1/1993 | |
| GB | 2464304 | A | 4/2010 | |
| GB | 2464304 | A | 4/2010 | |
| GB | 2525249 | A | 10/2015 | |
| KR | 20100003862 | A | 1/2010 | |
| WO | WO-9726424 | A1 * | 7/1997 | E04F 13/0807 |
| WO | 2010136737 | A | 12/2010 | |
| WO | WO-2010136737 | A1 * | 12/2010 | E04B 1/762 |
| WO | 2012001721 | A | 1/2012 | |
| WO | 2013097121 | A | 7/2013 | |
| WO | 2014122471 | A | 8/2014 | |
| WO | 2014/142776 | A | 9/2014 | |

OTHER PUBLICATIONS

International Preliminary Report on Patentability, International Patent Application No. PCT/GB2016/051051, dated Jul. 21, 2017, (9 pages).

International Search Report and Written Opinion, International Patent Application No. PCT/GB2016/051051, dated Jul. 6, 2016 (16 pages).

Written Opinion of the International Preliminary Examining Authority, International Patent Application No. PCT/GB2016/051051, dated Mar. 14, 2017 (8 pages).

* cited by examiner

FITTING EXTERNAL INSULATION SYSTEMS TO BUILDINGS

The present invention relates to a method of retro-fitting an external insulation system to a building. The present invention also relates to a retro-fit external insulation system for a building, and to a kit of parts which can be arranged to form a retro-fit external insulation system for a building.

It is well-known that the governments of many countries are making significant efforts to reduce emissions of Carbon Dioxide, commonly referred to as 'Carbon emissions'. European Union member states in particular have made commitments to reduce Carbon emissions, with penalties for countries that do not reduce them to agreed levels within specified time-periods.

A range of different options have been looked at for reducing Carbon emissions. One area of particular interest, in the United Kingdom and elsewhere, has been improving the thermal properties of domestic premises, i.e. buildings including houses and apartments. It has been recognised that significant reductions in Carbon emissions could be achieved by reducing heat loss from such premises, many of which are of a significant age.

A main focus of work has been the installation of insulation in existing premises having 'cavity walls', comprising an outer wall component (or 'outer skin') which is spaced from an inner wall component (or 'inner skin') by around 50 mm to perhaps 150 mm. This provides a cavity along which air can circulate, to prevent the transmission of moisture from the outer skin to the inner skin. The inner and outer skins are typically of substantial construction, in particular masonry comprising clay or stone bricks, or concrete masonry units (variously referred to as cement-block, breeze-block or cinder-block).

Whilst cavity walls have been found effective in reducing moisture transmission, the presence of cold air in the cavity does cause significant heat loss, through the inner skin into the cavity. Accordingly and as is well known in the insulation industry, techniques have been developed for filling these cavities with insulation material. A currently favoured technique is to 'blow' small (~5 mm) plastics pellets into the cavity, the pellets being coated with an adhesive so that they subsequently bind together in the cavity, and which resist moisture transmission from the outer skin to the inner skin.

Whilst this has been highly effective in reducing heat loss from cavity-walled buildings, this only addresses a small part of the problem. In particular, a very large number of domestic premises are of a 'solid wall' type, i.e. comprising a single wall component (or skin) of substantial construction, or of other non-traditional types (such as precast concrete, steel frame, system built etc.). Premises of this type tend to be of a significant age (usually 60 or more years old), and often tend to suffer from relatively high heat loss through the solid wall/non-traditional wall structure.

Obviously, cavity wall insulation techniques cannot be employed in premises of the solid-walled type, and the walls of non-traditional type premises do not possess cavities. External insulation systems have therefore been developed, which are applied to external surfaces of such premises. Whilst these provide an effective solution to the problem, vastly reducing heat loss, the current external insulation systems do suffer from a number of disadvantages.

Specifically, most current external insulation systems involve securing sheets of solid insulation material to the external surface of the solid wall, the sheets being of the order of 100 mm to 150 mm in thickness. This is a time-consuming, labour intensive procedure, which requires scaffold erection for the duration of the installation around the entire property, and is seriously impacted by cold and wet weather. In more detail, a typical procedure for applying external insulation systems involves firstly cleaning the external surface of the wall, to remove algae, moss and the like. An adhesive is then often applied to the cleaned external surface, and sheets of insulation applied, so as to cover the entire external surface of the premises. Whether or not adhesive is used, the insulation sheets are firmly secured to the wall using mechanical fixings, which extend through the sheets and penetrate into the wall. Typically around eight such fixings are used per square meter of insulation. A bonding adhesive is then applied to the external surfaces of the insulation sheets, which serves for securing a reinforcing mesh to the sheets. The mesh also provides a 'key' for a top coat or primer which is applied to the sheets, followed by a final surface render. If required, paint is applied to the render, once it has dried.

Problems with this procedure include the following. Firstly, cleaning the external surface of the wall is time-consuming and can be weather-dependent. The adhesives used to secure the insulation sheets to the wall, and the mesh to the insulation sheets, will not cure below 5° C. without the introduction of extra additives to the mix, costing more, and so cannot be applied in cold weather. Additionally, the adhesives cannot be applied in wet weather, as they will simply wash-off before they have a chance to cure. The mechanical fixings which secure the insulation sheets are time-consuming to insert, as they require a large number of holes to be drilled in the wall. Additionally, the fixings can potentially form a 'cold-bridge' for the transfer of heat from the wall through the insulation. The primer and final render also cannot be applied in cold or wet weather, and any required paint finish similarly is weather dependent. Finally, many different building trades are involved in applying the external insulation, making the procedure relatively labour-intensive and so costly. These various problems have the result that the typical time required to apply an external insulation system is of the order of 3 weeks, for an average-sized house.

German Patent Publication No. DE-4220071 discloses a facade for building purposes, which compensates for unevenness in brickwork and provides gapless insulation of an outer wall. Bearer plates are fixed on the wall that is to be insulated. Connecting plates receive the facades, and are secured to the bearer plates, using suitable fixings. A clay granulate material is used as the insulating material, and is supplied into a space behind the facades. The arrangement of bearer and connecting plates parts are adjustable to account for unevenness. However, this is a complex and time-consuming operation, particularly because a large number of bearer and connecting plates are required for mounting the facades. The bearer and connecting plates also impart relatively high point loads both on the wall and the facades, during use. In addition, the bearer and connecting plates act as a cold bridge through the insulation.

It is an object of the present invention to obviate or mitigate at least one of the foregoing problems or disadvantages.

According to a first aspect of the present invention, there is provided a method of retro-fitting an external insulation system to a building, the method comprising the steps of:

- mounting a plurality of support elements to an existing external surface of a wall of a building;
- providing a plurality of surface panels, each of which comprises an internal wall-facing surface and an external surface;

arranging the surface panels so that they cover at least a substantial part of the existing external surface of the wall;

mounting each surface panel to one or more of the support elements, so that cavities are defined between the internal wall-facing surfaces of the panels and the existing external surface of the wall; and supplying flowable insulation material into the cavities.

The method of the present invention provides significant advantages over prior methods of retro-fitting external insulation systems to buildings, of the type described above. There is no requirement to clean the external surface of the wall prior to fitting of the external insulation system. Additionally, the use of adhesives, as well as large volumes of surface primers and final renders can be avoided, or at least substantially reduced. The requirement for mechanical fixings extending through insulation sheets, providing a potential cold-bridge, can be avoided. Furthermore, in the method of the present invention, a number of cavities are formed between internal wall-facing surfaces of the panels and the existing external surface of the wall, and flowable insulation material is supplied into the cavities. This provides significant advantages over prior methods, which involve applying bulky, solid sheets of insulation material to a wall of a building, necessitating the need for scaffolding, the sheets being expensive to manufacture, transport on-site and install. The flowable insulation material is much more easily transported and supplied into the cavities when required. These and other advantages which follow from the method of the present invention can facilitate the retro-fitting of an external insulation system to a building in a matter of days, rather than weeks, as with prior methods.

The method may comprise closing tops of at least some of the cavities, which may be cavities that are uppermost on/relative to the wall, using at least one top or upper barrier member. The method may comprise closing cavities which are adjacent a top of the wall. Said top barrier member may prevent the flowable insulation material from flowing out of the tops of the cavities. The method may comprise arranging said top barrier member so that it allows water vapour to escape from the cavities. The method may comprise arranging said top barrier member so that water vapour can pass through it. This may be achieved by providing the top barrier member with a plurality of apertures. The method may comprise arranging said top barrier member so that it restricts, and optionally substantially prevents, liquid water from entering the cavities. This may be achieved by providing apertures which are sized to permit the passage of water vapour but to restrict, and optionally substantially prevent, the passage of liquid water. The skilled person will readily appreciate the size of apertures required to achieve this. The at least one top barrier member may be of a flexible material, which may be a flexible mesh-type material. This may provide the advantage that the top barrier member can flex to accommodate the flowable insulation material supplied into the cavities, which may cause the barrier member to flex outwardly.

The method may comprise closing bottoms of at least some of the cavities, which may be cavities that are lowermost on/relative to the wall, using at least one bottom or lower barrier member. The method may comprise closing cavities which are adjacent a bottom of the wall. Said bottom barrier member may prevent the flowable insulation material from flowing out of the bottoms of the cavities. The method may comprise arranging said bottom barrier member so that it allows liquid water to escape from the cavities. The method may comprise arranging said bottom barrier member so that liquid water can pass through the barrier member. This may be achieved by providing the bottom barrier member with a plurality of apertures. The method may comprise providing a bottom barrier member (or members) in which at least one dimension of the barrier member is adjustable. The dimension may be a depth of the barrier member, taken in a direction between the panels and the wall. This may provide the ability to accommodate and/or define cavities of different dimensions. The method may comprise mounting a first part of said bottom barrier member on the external surface of the wall, mounting a second part of said bottom barrier member to at least some of the panels, and coupling the first and second parts together so that the parts are movable relative to one-another, to vary said dimension. The parts may be coupled in a sliding arrangement.

The method may comprise arranging the insulation material so that liquid water in the cavities can pass through the insulation material to said bottom barrier member and so exit the cavities. The method may comprise arranging the insulation material so that water vapour in the cavities can pass through the insulation material to said top barrier member and so exit the cavities. The step of supplying flowable insulation material into the cavities may comprise supplying a plurality of particles of a solids insulating material into the cavities. Optional insulation materials will be discussed below. The method may comprise arranging the insulation material so that a plurality of channels, passages, pathways or the like are defined within the insulating material, through which liquid water and water vapour can pass. Said channels may be defined between the particles of solids material.

The method may comprise positioning at least one cover member above/over said top barrier member. Said cover member may serve to prevent liquid water (e.g. rainwater) from falling on to the at least one top barrier member. The method may comprise providing at least one cover member which is impermeable to liquid water. The method may comprise providing at least one cover member which defines a lower surface, and arranging the cover member so that the lower surface faces towards an upper surface of the at least one top barrier member. The lower surface may facilitate condensation of water vapour escaping from the cavities, and so may form a condensing surface. The method may comprise arranging at least part of the cover member, in particular the lower surface of the cover member, so that it is inclined relative to the horizontal and/or the top barrier member. This may facilitate the flow of water which has condensed on the surface off the cover member.

The step of mounting the support elements to the external surface may comprise:

positioning at least one adjustable spacer between at least some of the support elements and the surface, optionally between each support element and the surface, the spacer comprising a first end which abuts the surface and a second end which abuts the support element; and adjusting the spacer to vary (and/or accommodate) a space between the support element and the surface.

In a variation, the step of mounting the panels to the support elements may comprise:

positioning at least one adjustable spacer between at least some of the support elements and the panels, optionally between each support element and a respective panel or panels, the spacer comprising a first end which abuts the panel and a second end which abuts the support element; and adjusting the spacer to vary a space between the support element and the panel. In this situation, the support elements may be mounted directly to the external wall surface.

Mounting the support elements using such spacers may facilitate adjustment of the space to accommodate one or more of: variations/irregularities in the external surface (e.g. where portions of the surface are not in a common plane); variations in dimensions of the surface panels and/or the support elements; and variations in a fit of the surface panels and/or support elements to each other and/or to the surface. It may additional/alternatively facilitate adjustment of a dimension of the cavity.

The adjustable spacer may be a one-piece spacer. This may provide the advantage that the spacers are much easier to fit, compared to prior spacers.

The adjustable spacer may be of a material having insulating properties. Suitable materials include plastics materials, such as a Polycarbonate material. The adjustable spacer may be of a material having a relatively low heat transfer coefficient. A heat transfer coefficient of the spacer may be no more than about 0.20 W/(mK).

The method may comprise clamping the adjustable spacer between the support element and the wall surface. This may be achieved using a suitable fixing, which may pass through the support element and the spacer into the wall. This may provide a secure fixing of the support element, and indeed the spacer, to the wall. Where the spacer is provided between the panel and the support element, the spacer may be clamped between the panel and the support element.

The adjustable spacer may provide a substantially uniform distribution of load on the wall, during use. Where the spacer is provided between the panel and the support element, the substantially uniform load distribution may be on the panel. The spacer may be hollow. The spacer may be of a generally cylindrical tubular shape. This may facilitate application of the substantially uniform load.

The second end of the spacer may comprise a first mounting face which is at a first distance from the first end of the spacer, and a second mounting face which is at a second distance from the first end of the spacer, the second distance being greater than the first distance. The step of mounting the support elements may comprise adjusting the spacer between:

a first configuration in which the first mounting face abuts the support element; and a second configuration in which the second mounting face abuts the support element, to thereby adjust the space between the support element and the surface.

The second end of the spacer may comprise at least one further mounting face which is at a further distance from the first end from the spacer, the further distance being greater than the second distance. The step of mounting the support elements may comprise adjusting the spacer into at least one further configuration in which the further mounting face abuts the support element. The second end of the spacer may comprise a plurality of further mounting faces, each of which is at a respective further distance from the first end of the spacer than the preceding mounting face. The step of mounting the support elements may comprise adjusting the spacer into any one of a plurality of further configurations in which a respective further mounting face abuts the support element.

Reference is made herein to the retro-fitting of an external insulation system, to a retro-fit external insulation system for a building, and to a kit of parts which can be arranged to form a retro-fit external insulation system for a building. The reference to retro-fitting an external insulation system to a building should be understood to involve the fitting of an external insulation system to an existing external surface of a wall of a building, which external surface has previously formed an outermost surface of the building. This is to be distinguished from surfaces of a wall of a building which have never formed an external (outermost) surface of the wall, and which are never or have never been intended to form such surfaces.

The method may comprise retro-fitting the external insulation system to existing external surfaces of some, or all, of the walls of the building. It will be understood that many buildings, such as those of the terraced or semi-detached type in the United Kingdom, are joined to adjacent buildings so that they only have a front external wall, front and rear external walls, or front rear and one side (gable end) external wall.

The method may comprise mounting a first panel to the existing external surface of the wall (via the support elements), which panel may extend generally to a first maximum height above the ground, and then supplying flowable insulation material into the cavity defined between the internal wall facing surface of the panel and the existing external surface of the wall. The method may comprise mounting a first set of panels to the existing external surface of the wall, the set comprising a plurality of panels, the panels extending generally to a height above the ground which is not greater than a first maximum height (and then supplying the flowable insulation material). The method may comprise mounting at least one further panel to the existing external surface of the wall (via the support elements), which panel may extend generally to a second maximum height above the ground which is greater than said first height, and then supplying flowable insulation material into the cavity defined between the internal wall-facing surface of the panel and the existing external surface of the wall. The method may comprise mounting a second set of panels to the existing external surface of the wall, the set comprising a plurality of panels, the panels extending generally to a height above the ground which is not greater than a second maximum height which is greater than said first height (and then supplying the flowable insulation material). One or more further panel, or sets of panels, may be mounted.

The external surfaces of the panels may form or may comprise a decorative surface finish. The decorative surface finish may be a brick effect surface finish. The brick effect surface finish may comprise, or may be formed from, a plurality of brick slips. A sheet comprising a plurality of brick slips may be used. The slips may be of a plastics material e.g. a polymeric material, a resin-based material, a cementitious material or composites/mixtures thereof. The decorative surface finish may be a cement-based surface finish effect, such as a surface render, roughcast/pebbledash, stucco or plaster. The surface panels may comprise a backing sheet or board forming the internal wall-facing surface, and a decorative surface component forming at least part of the external surface of the panel. The decorative surface component may be provided integrally with the backing sheet or may be applied subsequently. The surface panels may comprise one or more intermediate components or layers, which may include: a reinforcement component; and/or one or more bonding layers. The reinforcement component may comprise a plurality of apertures and may be a mesh. The one or more bonding layers may be of an adhesive or cement-based material. The reinforcement component may be provided integrally with the decorative surface component. For example, the decorative surface component may be coupled to the reinforcement component, such as by embedding the reinforcement component into a rear of the decorative surface component.

The method may comprise carrying out a finishing procedure to form a desired surface finish. The finishing procedure may be carried out following mounting of the surface panels to the support elements. The finishing procedure may comprise one or more of the following:

a) applying a surface finish material to an intersection or intersections between adjacent surface panels;
b) applying a surface finish material to a portion of the external surfaces of the surface panels; and
c) applying a surface finish material to a substantial part of (and optionally all of) the external surfaces of the surface panels.

Step a) may comprise positioning at least one pre-formed surface finish arrangement or element so that it straddles a pair of adjacent surface panels. Where the decorative surface finish involves forming a brick effect, employing slips, step a) may comprise positioning at least one slip straddling a pair of adjacent surface panels.

Step b) may comprise applying a cement-based surface finish material to said portions of the external surfaces. Where a decorative surface finish in the form of a brick effect is provided, employing slips, the slips may be arranged so that spaces for receiving a cement based material (e.g. a grout, mortar or the like) are provided between adjacent slips, and the method may comprise supplying the cement based material into said spaces.

Step c) may comprise applying a cement-based surface finish material to the external surfaces of the panels. The cement-based surface finish material may be a surface render, roughcast/pebbledash, stucco, plaster or the like.

The method may comprise the step of securing each surface panel to at least one adjacent surface panel. Each panel may comprise at least one interface component which cooperates with said adjacent panel. The interface component may be moveable from a position out of cooperation with said adjacent panel to a position in cooperation with said panel. The interface component may be deformable for movement between said positions. The interface component may be a sheet or sheet-like component. The interface component may have a plurality of apertures extending through it. The apertures may serve for receiving a bonding material, which may be an adhesive or a cement-based material. The interface component may be foldable to overlap said adjacent surface panel. Each surface panel may comprise at least one interface zone, which may be provided at or adjacent an edge of the panel, and which receives the interface component of an adjacent panel. The method may comprise performing step a) following securing of each surface panel to said adjacent surface panel.

Reference is made herein to the supply of a flowable insulation material into the cavities. The reference to a flowable insulation material should be understood to encompass any insulation material which is capable of flowing into the cavities. The insulation material may comprise a plurality of particles of a solids material, suitably a plastics material, and which may be beads, pellets, granules or the like. Suitable insulation materials include expanded polystyrene (EPS) beads. The plurality of particles may have a time-setting coating applied to them, such as an adhesive. Alternatively, the flowable insulation material may be a time-setting fluid or gel-based material, for example a foam. Combinations of different flowable insulation materials may be employed.

The use of insulation material comprising a plurality of particles of a solids material such as beads, pellets, granules or the like, and in particular expanded polystyrene (EPS) beads, provides significant advantages, in the context of the present invention. In particular, a large number of pathways are formed through the beads contained in the cavities, through which liquid water can flow and water vapour can pass, for expulsion from the cavities through the bottom and top barrier members, respectively. This may not be possible with other types of insulation material such as foams, for example plastics (e.g. polystyrene) foams. The beads can also be readily 'blown' into the cavities, and are significantly easier to handle than other types of insulation material.

The surface panels may each have a length, a height and a shape (or profile). The length, height and/or shape of at least one surface panel may differ from the length, height and/or shape of at least one other surface panel. The method may comprise pre-forming the surface panels so that they each have a required length, height and/or shape (or profile) prior to mounting the panels to the support elements. Advantageously, this may be carried out off-site, which may speed the process of retro-fitting the insulation system to the building. The method may comprise: assessing the length, height and/or shape (or profile) of the surface panels required to cover at least the substantial part of the existing external surface of the wall; and pre-forming surface panels of the required length, height and/or shape (or profile).

Each surface panel may be mounted to at least two spaced support elements.

The method may comprise providing insulation containment elements at: ground level; in the vicinity of any window lintels; and/or in the vicinity of any door lintels. The insulation containment elements may prevent any flowable insulation material from leaking out of the cavities. The insulation containment elements may be elongate, and may be boards, panels or the like.

The cavities may be at least partially bound by the existing external surface of the wall, the internal wall-facing surface of one or more surface panel, and a pair of spaced support elements. The cavities may be at least partially bound by an insulation containment element(s).

The support elements may be of a material having insulating properties. The support elements may be of a material having a relatively low heat transfer coefficient. A heat transfer coefficient of the support elements may be no more than about 1 W/(mK). A heat transfer coefficient of the support elements may be no more than about 0.75 W/(mK). A heat transfer coefficient of the support elements may be no more than about 0.20 W/(mK). The heat transfer coefficient may be no more than about 0.15 W/(mK). The heat transfer coefficient may be no more than about 0.10 W/(mK). The heat transfer coefficient may be no more than about 0.05 W/(mK). Suitable materials include wood and wood-based materials (e.g. plywood, MDF, chipboard). The heat transfer coefficients of suitable wood materials may be as follows: ~0.17 W/(mK) for oak; ~0.12 W/(mK) for pine, measured across the wood grain.

The support elements may be arranged so that they stand proud of the wall surface, so that the cavities are defined when the panels are mounted to them. A mounting surface for the panels, defined by the support elements, may therefore be spaced from the wall surface.

The support elements may be elongate members, and may be arranged so that they extend across a dimension of the surface panels, which may be a height dimension. This may provide good support for the panels. The support members may be beams, slats or spacers.

The support elements may be support pads, blocks or the like. The support pads may be arranged so that they provide support for the surface panels at locations which are spaced apart across their wall-facing surfaces. The support pads may only extend part way across the dimensions of the surface panels, in particular a height dimension. Advantageously, this may reduce an area of contact between the support pads and the existing external surface of the wall, and so heat transfer from the wall.

The support elements may each comprise an elongate member, coupled to a plurality of support pads (or blocks or the like), which may each be of the type described above. The pads may be spaced apart along a length direction of the members. The elongate members may be arranged so that they contact the wall-facing surfaces of the panels, and the support pads may be arranged so that they contact the existing external surface of the wall, to thereby mount the panels to the wall surface. The elongate members may be provided integrally with the support pads, or separately and subsequently coupled together.

The support elements may be arranged so that they are substantially vertically oriented, spaced apart across a width of the wall. The support elements may be arranged so that they are substantially horizontally oriented, spaced apart across a height dimension of the wall.

The support elements may be secured to the wall using first fixings, and the panels may be secured to the support elements using second fixings which are separate from the first fixings. Advantageously, this may avoid the provision of a cold bridge extending through the insulation material.

According to a second aspect of the present invention, there is provided a retro-fit external insulation system for a building, the system comprising:

- a plurality of support elements, the support elements being mountable to an existing external surface of a wall of a building;
- a plurality of surface panels, each of which comprises an internal wall-facing surface and an external surface; and
- a flowable insulation material;
- in which the plurality of surface panels are adapted to cover at least a substantial part of the existing external surface of the wall;
- and in which the surface panels are each adapted to be mounted to one or more of the support elements, so that cavities are defined between the internal wall-facing surfaces of the panels and the existing external surface of the wall, into which the flowable insulation material can be supplied.

According to a third aspect of the present invention, there is provided a kit of parts which can be arranged to form a retro-fit external insulation system for a building, the kit of parts comprising:

- a plurality of support elements, the support elements being mountable to an existing external surface of a wall of a building;
- a plurality of surface panels, each of which comprises an internal wall-facing surface and an external surface; and
- a flowable insulation material;
- in which the plurality of surface panels are adapted to cover at least a substantial part of the existing external surface of the wall;
- and in which the surface panels are each adapted to be mounted to one or more of the support elements, so that cavities are defined between the internal wall-facing surfaces of the panels and the existing external surface of the wall, into which the flowable insulation material can be supplied.

The insulation system may comprise at least one top or upper barrier member for closing tops of at least some of the cavities, which may be cavities that are uppermost on/relative to the wall. Said top barrier member may be arranged to allow water vapour to escape from the cavities. Said top barrier member may be arranged so that water vapour can pass through it. This may be achieved by providing the top barrier member with a plurality of apertures. Said top barrier member may be arranged so that it restricts, and optionally substantially prevents, liquid water from entering the cavities. This may be achieved by providing apertures which are sized to permit the passage of water vapour but to restrict, and optionally substantially prevent, the passage of liquid water.

The insulation system may comprise at least one bottom or lower barrier member for closing bottoms of at least some of the cavities, which may be cavities that are lowermost on/relative to the wall. Said bottom barrier member may be arranged so that it allows liquid water to escape from the cavities. Said bottom barrier member may be arranged so that liquid water can pass through the barrier member. This may be achieved by providing the bottom barrier member with a plurality of apertures. At least one dimension of said barrier member may be adjustable. The dimension may be a depth of the barrier member, taken in a direction between the panels and the wall. Said bottom barrier member may comprise a first part which is mountable on the external surface of the wall, and a second part which is mountable to at least some of the panels, in which the first and second parts are coupled together so that the parts are movable relative to one-another, to vary said dimension. The parts may be coupled together in a sliding arrangement/fit.

The insulation system may comprise an insulation material which can be arranged so that liquid water in the cavities can pass through the insulation material to said bottom barrier member and so exit the cavities. The insulation system may comprise an insulation material which can be arranged so that water vapour in the cavities can pass through the insulation material to said top barrier member and so exit the cavities. The insulation material may comprise a plurality of particles of a solids insulating material. Optional insulation materials are discussed elsewhere in this document. The insulation material may be of a type which can be arranged in the cavities so that a plurality of channels, passages, pathways or the like are defined within the insulating material, through which liquid water and water vapour can pass. Said channels may be defined between the particles of solids material.

The insulation system may comprise at least one cover member which can be positioned above/over said top barrier member. Said cover member may be impermeable to liquid water. Said cover member may define a lower surface, and may be adapted to be arranged so that the lower surface faces towards an upper surface of the at least one top barrier member. The lower surface may form a condensing surface to facilitate condensation of water vapour escaping from the cavities. At least part of said cover member, in particular the lower surface of the cover member, may be arranged so that it is inclined relative to the horizontal and/or the top barrier member.

The insulation system may comprise a plurality of adjustable spacers, each of which can be positioned between a support element and the surface, the spacers comprising a first end adapted to abut the surface and a second end adapted to abut the support element, in which the spacer can be adjusted so that a space between the support element and the surface can be varied. Optionally, the spacers are positioned between each support element and the external surface of the wall.

In a variation, the spacers may each be adapted to be positioned between a support element and a panel, the spacer comprising a first end which abuts the panel and a second end which abuts the support element, in which the spacer can be adjusted so that a space between the support element and the panel can be varied.

The adjustable spacer may be a one-piece spacer.

The adjustable spacer may be of a material having insulating properties. Suitable materials include plastics materials, such as a Polycarbonate material. The adjustable spacer may be of a material having a relatively low heat transfer coefficient. A heat transfer coefficient of the spacer may be no more than about 0.20 W/(mK).

The adjustable spacer may be clamped between the support element and the wall surface. This may be achieved using a suitable fixing, which may pass through the support element and the spacer into the wall. Where the spacer is provided between the panel and the support element, the spacer may be clamped between the panel and the support element.

The adjustable spacer may provide a substantially uniform distribution of load on the wall, during use. Where the spacer is provided between the panel and the support element, the substantially uniform load distribution may be on the panel. The spacer may be hollow. The spacer may be of a generally cylindrical tubular shape. This may facilitate application of the substantially uniform load.

The second end of the spacer may comprise a first mounting face which is at a first distance from the first end of the spacer, and a second mounting face which is at a second distance from the first end of the spacer, the second distance being greater than the first distance. The spacer may be adjustable between:

- a first configuration in which the first mounting face is arranged to abut the support element; and
- a second configuration in which the second mounting face is arranged to abut the support element,
- to thereby adjust the space between the support element and the surface.

The second end of the spacer may comprise at least one further mounting face which is at a further distance from the first end from the spacer, the further distance being greater than the second distance. The spacer may be adjustable into at least one further configuration in which the further mounting face abuts the support element. The second end of the spacer may comprise a plurality of further mounting faces, each of which is at a respective further distance from the first end of the spacer than the preceding mounting face. The spacer may be adjustable into any one of a plurality of further configurations in which a respective further mounting face abuts the support element.

Further features of the retro-fit external insulation system of the second aspect of the invention, and/or of the kit of parts of the third aspect of the present invention, may be derived from the text set out above relating to the method of the first aspect of the invention.

The kit of parts of the third aspect of the invention may comprise a group comprising a plurality of surface panels, the surface panels each having a length, a height and a shape (or profile), in which the length, height and/or shape of at least one surface panel differs from the length, height and/or shape of at least one other surface panel. Some (not all) of the surface panels may be selected from the group for mounting to the support elements. The group of panels may comprise a range of panels of length, height and/or shape suited to a wide range of buildings, so that panels appropriate to the building in question can be selected for covering said part of the existing external surface of the wall.

The kit of parts may comprise ancillary items required to mount the insulation system, which may comprise one or more of: junction materials, reveals, top-stop profiles, draining base track, fixings and/or other components.

Some of all of the parts of the kit of the third aspect of the invention (or the components of the system of the second aspect) may be adapted to be provided in flat-packed form. Said parts may comprise at least the surface panels, and optionally the support elements.

According to a fourth aspect of the present invention, there is provided an adjustable spacer for mounting a building element to a surface so that a space is defined between the building element and the surface, the spacer being adjustable to vary a dimension of the space and comprising:

- a first end adapted to abut the surface; and
- a second end adapted to abut the building element, the second end comprising:
  - a first mounting face which is at a first distance from the first end of the spacer; and
  - a second mounting face which is at a second distance from the first end of the spacer, the second distance being greater than the first distance;
- in which the spacer is adjustable between:
  - a first configuration in which the first mounting face is arranged to abut the building element; and
  - a second configuration in which the second mounting face is arranged to abut the building element,
- so that the space between the building element and the surface can be adjusted.

The second end of the spacer may comprise at least one further mounting face which is at a further distance from the first end from the spacer, the further distance being greater than the second distance. The spacer may be adjustable between the first configuration, the second configuration and at least one further configuration in which the further mounting face is arranged to abut the building element. The second end of the spacer may comprise a plurality of further mounting faces, each of which is at a respective further distance from the first end from the spacer than the preceding mounting face. The spacer may be adjustable between the first configuration, the second configuration, and any one of a plurality of further configurations in which a respective further mounting face is arranged to abut the building element.

The mounting faces of the spacer may each comprise a plurality of mounting face portions which together define the mounting face. The mounting face portions may be discrete. The mounting face portions may be spaced apart.

The mounting faces may be spaced around a periphery of the spacer at the second end. The spacer may be hollow. At least a part of the spacer forming the second end may be of a generally cylindrical tubular shape. The mounting faces may be spaced around a circumference of the spacer at the second end.

The mounting faces may be defined by at least one support, which may take the form of a ledge, shelf or the like. The supports may be arranged transverse to a main axis of the spacer (extending between the first and second ends), and may be arranged substantially perpendicularly to the main axis. Each mounting face may be defined by a plurality of supports which together define the respective mounting face. The supports of each mounting face may be provided at a common distance from the first end of the spacer. The supports may be spaced apart around a periphery, optionally a circumference, of the spacer. Where the spacer has a generally cylindrical tubular shape, the supports of each mounting face may be arranged on a line passing through a centre of the spacer.

The spacer may comprise restraints for restraining rotation of the spacer relative to the building element. The restraints may be arranged to cooperate with lateral sides or edges of the building element. The restraints may cooperate with a mounting face. Each mounting face may cooperate with at least one restraint. A pair of restraints may cooperate with a mounting face to define a channel, slot, recess or the like for receiving the building element. The restraints may restrain rotation of the spacer relative to the building element, and the mounting face may support the building element at the respective distance from the first end of the spacer. The restraints may extend in a direction which is generally parallel to a main axis of the spacer (extending between the first and second ends).

The spacer may be adjustable between its different configurations by rotation of the spacer about a main axis extending in a direction between the first and second ends. This may enable adjustment to be carried out relatively quickly and easily, compared to prior spacers.

The spacer may define a channel, slot or the like at the second end, which is adapted to receive the building element. Said channel may restrict relative rotation between the spacer and the building element.

According to a fifth aspect of the present invention, there is provided an adjustable spacer for mounting a building element to a surface so that a space is defined between the building element and the surface, the spacer being adjustable to vary a dimension of the space and comprising:

- a first spacer component defining a first end of the spacer, the first end adapted to abut the surface; and
- a second spacer component defining a second end of the spacer, the second end comprising a mounting face which is adapted to abut the building element;
- in which the first and second spacer components are movably coupled so that a distance between the first end and the mounting face of the second end can be varied, to adjust the space between the building element and the surface;
- and in which the spacer further comprises a restraining component for selectively restraining movement of the second spacer component relative to the first spacer component in a direction towards the first end, to fix the distance between the first end and the mounting face of the second end and so a dimension of the space.

One of the first and second spacer components may be a female component and the other a male component, the female component being shaped to receive the male component in a sliding fit.

The restraining component may be positionable around and/or countable to one of the spacer components, and arranged to abut the other one of the first and second spacer components, to thereby restrain said movement of the second spacer component. The restraining component may be adapted to be provided at the first end of the spacer and to abut the second spacer component. The restraining component may be shaped to fit around one of the spacer components. The restraining component may be elastically deformable for engagement around one of the spacer components, and may be a sprung component. The restraining component may be a shim, collar, cuff or the like. The restraining component may be split, and may be in the general shape of a split-ring, which may comprise a gap defined between circumferential edges of the ring, and the ring may be elastically deformable so that the gap can be expanded to fit the ring around said spacer component.

The restraining component may be adapted to be cut to the required length, to suit the dimensions of the space which the spacer is required to bridge. The spacer may comprise a plurality of restraining components, each having a respective length in a direction along a main axis of the spacer (extending between the first and second ends). In this way, a spacer of a desired length may be selected, for defining a desired distance between the first end of the spacer and the mounting face of the second end.

Optional further features of the spacers of the above aspects of the invention are as follows.

The spacer may be hollow, defining an internal cavity which extends between the first and second ends. The internal cavity may be adapted to receive a flowable insulation material. The internal cavity may be adapted to receive an anchor used to secure the building element to the surface. The spacer may comprise at least one aperture extending through a side wall of the spacer, said aperture communicating with the internal cavity. This may facilitate the flow of insulation material into/out of the cavity. At least one aperture may be provided at/adjacent the first end of the spacer.

The building element may be any desired building element.

The building element may be an elongate building element. The building element may be a support element for mounting a surface panel to an external surface of a wall of a building, or to some other surface. The building element may be a joist, beam or other element used for supporting a roof, floor, deck or the like on or from the surface (which may be any desirable surface).

The building element may be a surface panel, which is to be mounted to an external surface of a wall of a building, or to some other surface. The building element may be a roof, floor, deck or the like which is to be mounted to or on the surface (which may be any desirable surface). Optionally, a further/different building element, which may be an elongate building element and which may be a joist, beam or other element, may be located between the spacer and the surface.

Further features of the method of the first aspect of the invention, the insulation system of the second aspect, and the kit of the third aspect which employ a spacer may be derived from or with reference to the text set out above relating to the adjustable spacers of the fourth or fifth aspects of the invention.

In a further aspect of the invention, there is provided an adjustable spacer of the type which optionally forms part of the system of the second aspect of the invention.

Embodiments of the present invention will now be described, with reference to the accompanying drawings, in which.

Figure 1:
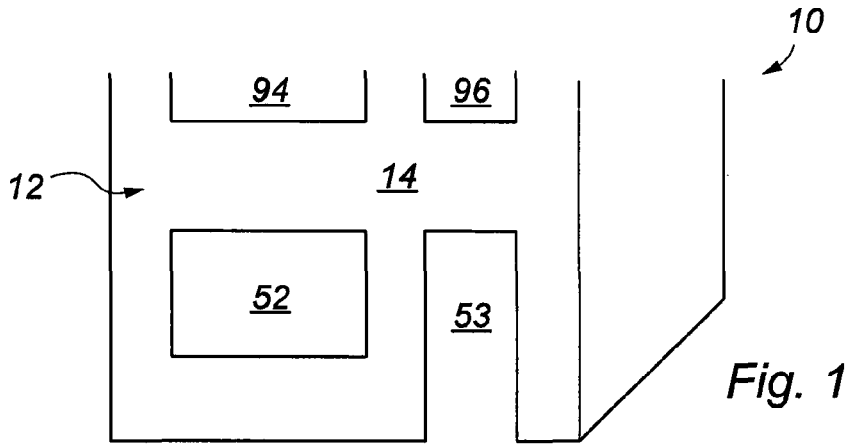
FIG. 1 is a schematic perspective view of part of a building to which an external insulation system can be retro-fitted, according to a method of the present invention.
Figure 2:
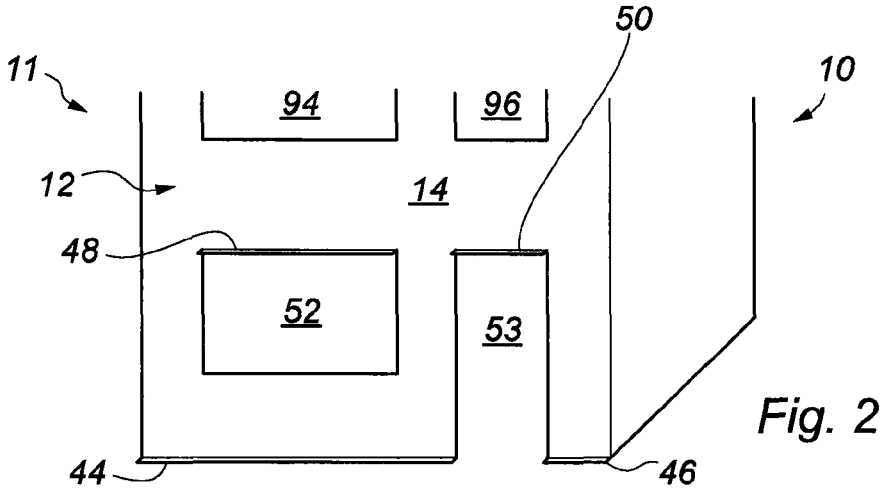
FIGS. 2 to 8 are views of the building shown in FIG. 1, illustrating steps in a method of retro-fitting an external insulation system, and a retro-fit external insulation system, according to an embodiment of the present invention.

Turning firstly to FIG. 1, there is shown part of a building 10 to which an external insulation system can be retro-fitted, according to a method of the present invention. It will be understood from the following description that the method/system of the present invention can be employed to retro-fit external insulation to a wide range of buildings, and in particular that the retro-fit external insulation system can be fitted to an external surface of a wall or walls of any suitable building.

The building 10 may be of any suitable shape and dimensions, but is typically a domestic premises such as a house. The house 10 may be a terraced or semi-detached house, but may be any other suitable type of house including a detached house. The method of the present invention may also be applied to the external walls of apartment buildings.

Turning now to FIGS. 2 to 8, there are shown views of the house 10 of FIG. 1 illustrating steps in a method of retro-fitting an external insulation system, and a retro-fit external insulation system, according to an embodiment of the present invention, the system indicated in the drawings by reference numeral 11.

The house 10 includes a wall 12 which, in the illustrated embodiment, is a front wall of the house. The front wall 12 has an existing external surface 14, which has formed the outermost surface of the front wall 12. The house 10 is of a "solid wall" type, comprising a single wall component or skin of substantial construction, for example of masonry construction such as brick, stone or a combination of the two. Houses having walls of this type do not possess a cavity into which insulation material can be supplied, to reduce heat loss from the building. Whilst the method of the present invention has a use with a wide range of different types of buildings, having different wall constructions (and so not restricted to solid wall type buildings), the method does have a particular use with buildings having a solid wall construction.

Figure 3:
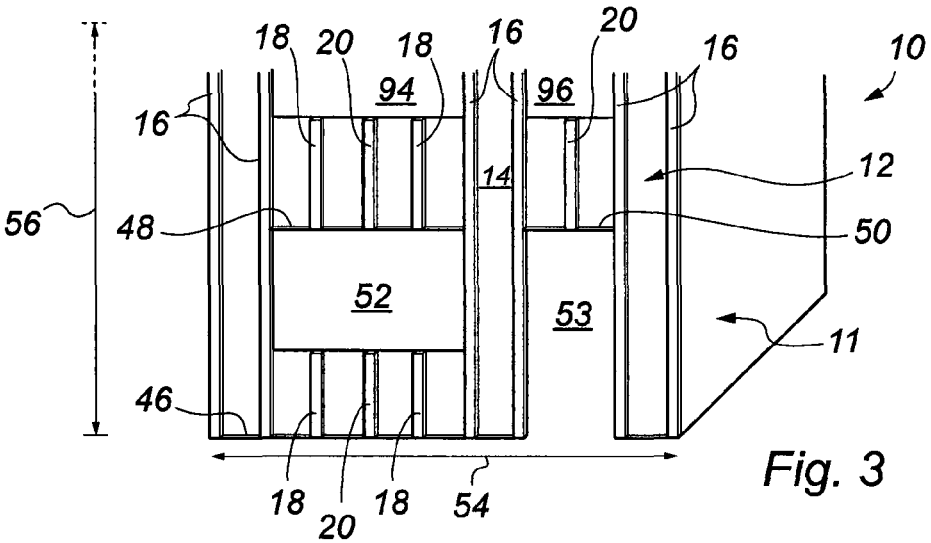

The method of the present invention generally comprises the following steps. Referring to FIG. 3, a plurality of support elements, indicated variously by reference numerals 16, 18 and 20, are mounted to the existing external surface 14 of the house 10. The support elements 16, 18 and 20 are typically mounted by means of suitable fixings, which will be discussed below.

Figure 5:
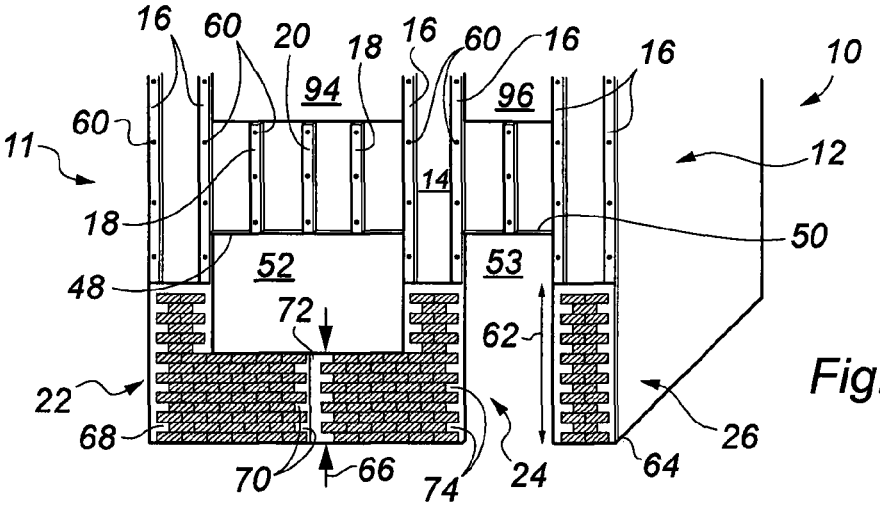
Figure 6:
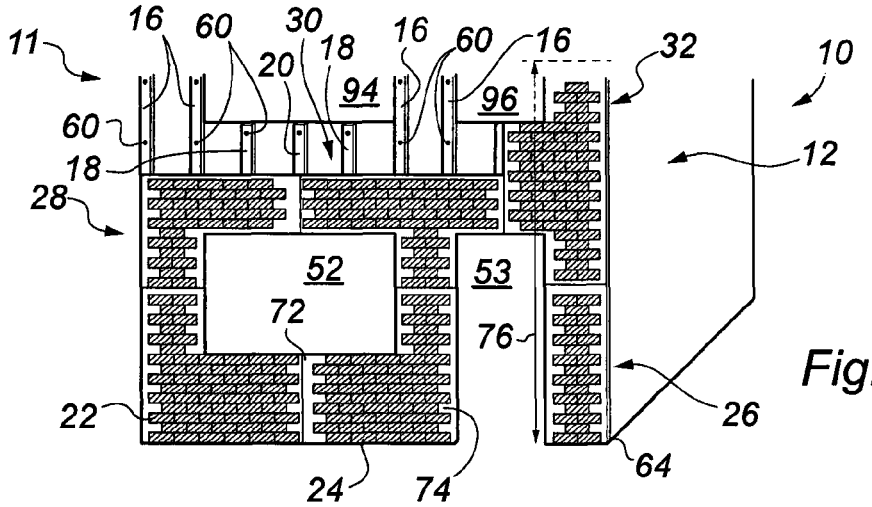
Figure 7:
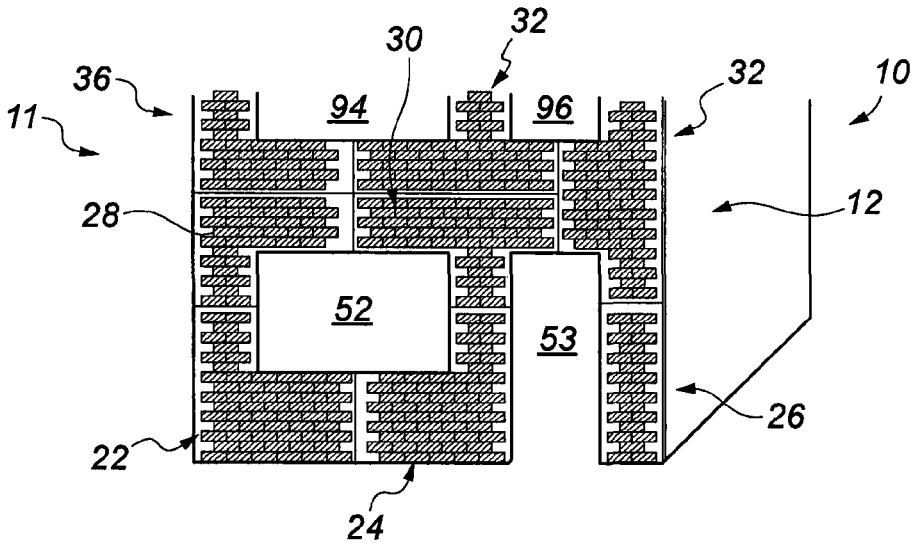
Figure 9:
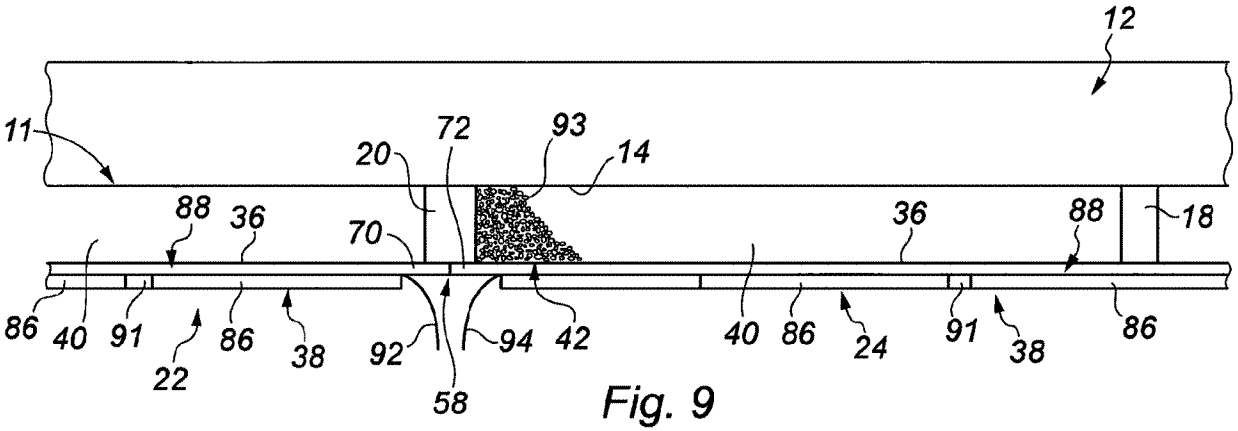
FIGS. 9 and 10 are schematic plan views of the retro-fit external insulation system of FIGS. 2 to 8, showing further detail on steps in the method.

A plurality of surface panels are provided, which are shown variously in FIGS. 5 to 7 and which are indicated by reference numerals 22, 24, 26, 28, 30, 32 and 34, as well as numerals 78, 80 and 82. FIG. 9, which is a schematic plan view of the external insulation system, shows the surface panels 22 and 24 in more detail. The surface panels 22 to 34 and 78 to 82 each comprise an internal wall-facing surface and an external surface, the internal wall-facing surfaces of the panels 22 and 24 being shown in FIG. 9, indicated by reference numeral 36, and the external surfaces shown and indicated by reference numeral 38. Whilst only the panels 22 and 24 are shown in FIG. 9 and will be described in detail herein, it will be understood that the remaining panels 26 to 34 are of like construction, and that similar reference numerals will be employed in relation to common features of the panels.

The surface panels 22 to 34 and 78 to 82 are arranged so that they cover at least a substantial part of the existing external surface 14 of the wall 12 and, in the illustrated embodiment, cover the entire existing external surface 14. The surface panels 22 to 34 are mounted to one or more of the support elements 16, 18 and 20, so that cavities 40 are defined between the internal wall-facing surfaces 36 of the panels, and the existing external surface 14 of the wall 12. These cavities 40 are shown in FIG. 9.

Finally, a flowable insulation material 42 is supplied into the cavities 40, again as shown in FIG. 9. Only a part of one of the cavities 40 is shown filled with the flowable insulation material 42, for ease of illustration. It will be understood, however, that the cavities 40 are filled with the insulation material 42, to provide optimum insulating performance.

The method and retro-fit external insulation system of the present invention addresses many of the problems with prior systems and methods, and enables fitting of external insulation system to a building in a much shorter timeframe than with the prior methods.

In particular, the method and external insulation system of the present invention addresses numerous problems with prior methods and systems because it effectively involves the creation of a cavity which is external to the existing external surface of the building in question, and the filling of that cavity with a suitable flowable insulation material. This avoids the need to meticulously clean the external surface of the wall to which the insulation system is to be applied. Additionally, the use of time-setting adhesives, renders and the like can be dispensed with. Furthermore, the requirement to provide fixings extending through insulation material applied to the external surface of the building can be reduced, thereby reducing the risk of the formation of a cold bridge. As a result, the many different building trades which are involved in applying prior external insulation systems to buildings can be greatly reduced, thereby reducing the labour and cost involved in applying the external insulation system of the present invention to a building. Additionally, adverse weather conditions are of significantly less concern.

The method and retro-fit external insulation system of the present invention will now be described in more detail.

Returning to FIG. 2, a first step in the method is shown, which involves the positioning of insulation containment elements 44 and 46 at ground level, and similar such elements 48 and 50 in the region of window 52 and door 53 lintels, the lintels being embedded within the structure of the wall 12 and so not shown in the drawing. These insulation containment elements 44 to 50 are each elongate, taking the general form of boards or panels which are secured to the existing external surface 14 of the house 12, such as via designated brackets and fixings (not shown), supplied as part of a 'Kit of Parts' for assembling the insulation system. The purpose of these boards 44 to 50 is to contain the flowable insulation material 42 which is subsequently supplied into the cavities 40, as shown in FIG. 9. However, the boards 44 to 50 may also facilitate drainage of any moisture that might collect in the cavities 40, and so may take the form of/comprise draining profiles.

The support elements 16, 18 and 20 shown in FIG. 3 are each generally elongate, taking the form of beams, slats or spacers, and are typically of a material having insulating properties. Suitable materials include wood and wood based products such as wood composites, e.g. plywood. Materials of this type have a low heat transfer coefficient, reducing heat loss from the wall 12 where the support elements contact the existing external surface 14. Typical heat transfer coefficients of suitable materials may be no more than about 1 W/(mK), no more than about 0.75 W/(mK), no more than about 0.20 W/(mK), no more than about 0.15 W/(mK), no more than about 0.10 W/(mK) and may be as low as about 0.05 W/(mK). The heat transfer coefficients of suitable wood materials may be ~0.17 W/(mK) for oak, and ~0.12 W/(mK) for pine, measured across the wood grain. The support elements 16, 18 and 20 are generally vertically oriented, spaced apart across a width 54 of the wall 12. The support elements 16 are longer than the support elements 18 and 20, since they extend along a full height of the wall 12, indicated by numeral 56 in FIG. 3. The support elements 16, 18 and 20 are typically of a similar width, which may be of the order of 70 mm. Optionally however, the support elements 20, which are at intersection regions between adjacent panels, may be slightly wider.

Figure 4:
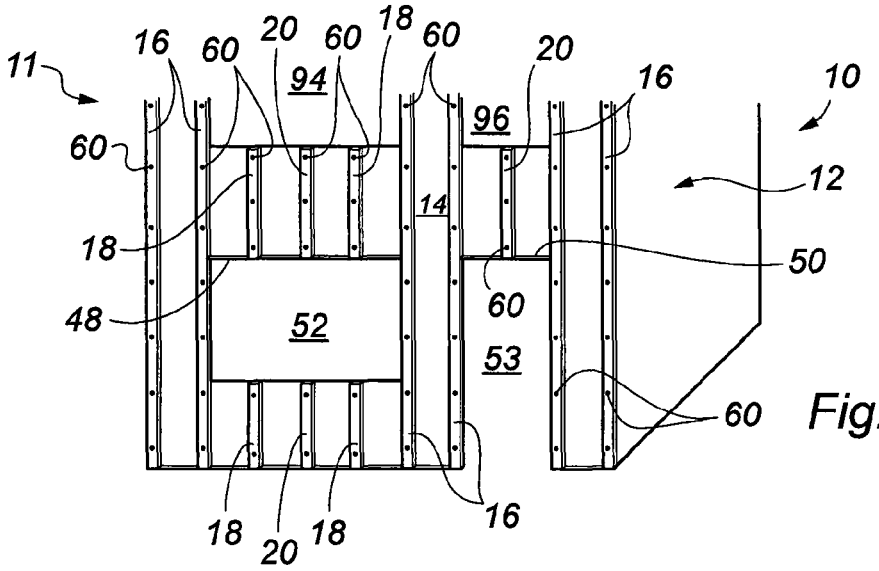

All of the support elements 16, 18 and 20 are secured to the wall 12 using suitable fixings, the fixings indicated generally by reference numeral 60 in FIG. 4. Only some of the fixings 60 have been labelled in the drawing, but the locations of the further fixings can clearly be seen. The fixings 60 extend through the support elements 16, 18 and 20 and penetrate the existing external surface 14 some distance into the wall 12, so that the support elements are securely anchored to the external surface. The fixings 60 will not be described in detail herein, but the skilled person will be well aware of fixings of suitable types which may be employed to secure the support elements 16 to 20.

Turning now to FIG. 5, the surface panels 22, 24 and 26 are shown following mounting to the support elements 16, 18 and 20. The surface panels 22, 24 and 26 form a first set of surface panels which are mounted to the existing external surface 14 of the house 12, via the support elements 16, 18 and 20. The surface panels 22, 24 and 26 in this first set of panels extend generally to a first maximum height 62 above ground 64 level. As can be seen from the drawing though, the panels 22 and 24 accommodate the window 52, and so have portions which are of a lower height 66 above the ground 54 level.

The panels 22, 24 and 26 are mounted to the support elements 16, 18 and 20 (as appropriate) using designated fixings (not shown), supplied as part of the 'Kit of Parts', and which will again be of a type readily understood by the skilled person. The fixings typically extend through interface zones provided adjacent edges of the respective panels. Referring for example to the surface panels 22 and 24, these comprise a number of interface zones, indicated by reference numerals 68 and 70 (panel 22), and 72 and 74 (panel 24). Advantageously, the fixings which are used to secure the surface panels 22 to 34 to the support elements 16 to 20 (and so to the existing external surface 14 of the wall 12) can be separate from the fixings 60 which are used to secure the support elements themselves. In this way, the formation of a cold-bridge, extending from the wall 12 through to the external surfaces 38 of the surface panels 22 to 34, can be avoided.

Mounting of the first set of surface panels 22 to 26 effectively defines a first set of cavities 40, extending up to the first maximum height 62. The flowable insulation material 42 is then supplied into those cavities 40, prior to mounting of any further surface panels to the wall 12. This facilitates supply of the flowable insulation material 42 into the first set of cavities 40, and ready verification that the insulation material has properly filled the cavities. This is because the insulation material 42 only needs to fill the cavities 40 to the first maximum height 62, and it can readily be determined whether or not the insulation material has packed down into the cavities to fill them.

Turning now to FIGS. 6 and 7, a second set of surface panels comprising the panels 28, 30, 32, 34 and 36 are then mounted to the existing external surface 14 of the wall 12, again via the support elements 16 to 20, as appropriate. The surface panels 28, 30 and 32 in the second set extend to a second maximum height 76 above ground 64 level, and are mounted to the support elements 16 to 20 in a similar way. Once again, flowable insulation material 42 is supplied into the cavities 40 defined between the internal wall facing surfaces 36 of the surface panels 28 to 32, and inspection of the cavities 40 carried out prior to mounting further surface panels.

Figure 8:
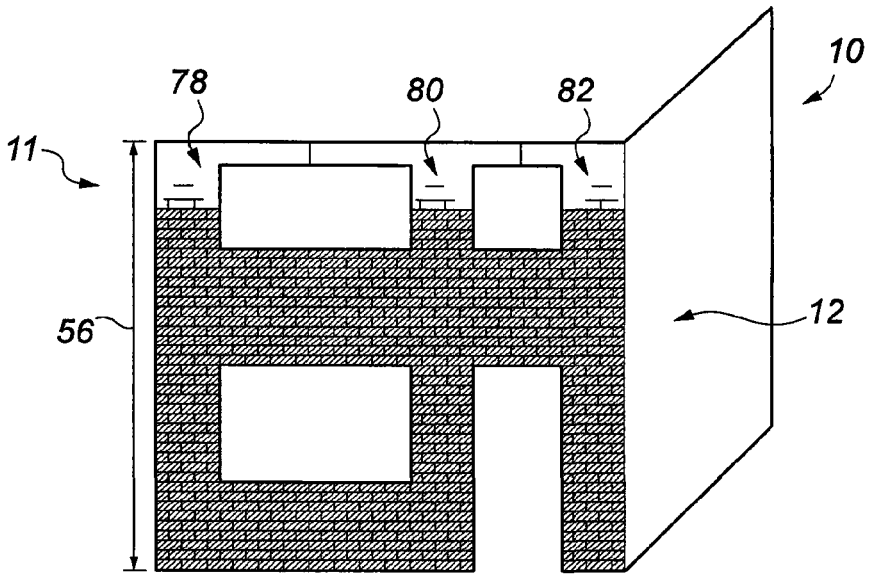

FIG. 8 shows the wall 12 following mounting of a third set of surface panels, whose locations are indicated schematically at 78, 80 and 82, and which extend up to the full height 56 of the wall 12. These panels 78 to 82 are mounted in the same way as described above, and so have with the cavities 40 which they define filled in the same fashion. Following mounting of this third set of panels 78 to 82, the entire existing external surface 14 of the front wall 12 of the house 10 has been covered.

In a variation on the above, the cavities 40 may be filled with the flowable insulation once panels have been installed extending across the full elevation of the wall surface 14. In other words, the insulation material may only be supplied into the cavities once all of the panels have been installed, covering the wall surface 14.

Figure 10:
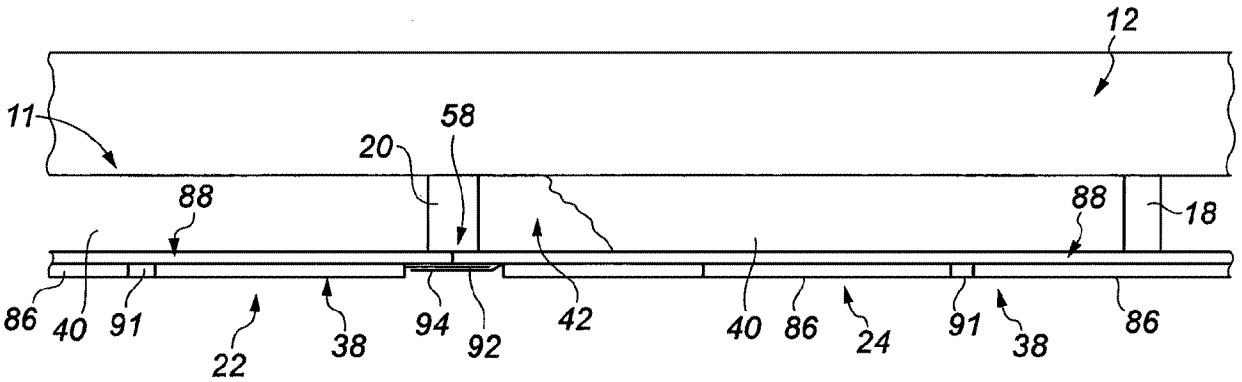
Figure 11:
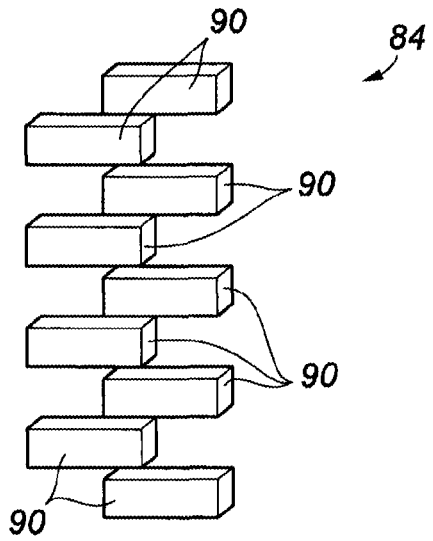
FIG. 11 is an enlarged perspective view of a pre-formed surface finish element, forming part of the external insulation system.

We now return to FIG. 9, and will refer also to FIG. 10, which is a view similar to FIG. 9 showing further steps in the method, and FIG. 11, which is an enlarged perspective view of a pre-formed surface finish arrangement 84 forming part of the system.

The external surfaces 38 of the surface panels 22 to 34 and 78 to 82 comprise a decorative surface finish. Many different surface finishes could be provided, but in the illustrated embodiment, a brick effect surface finish is provided. This is achieved using a plurality of brick slips 86, which form a majority of the external surface 38 of each surface panel. The brick slips 86 are of a type known in the building industry, and are typically of suitable plastics (e.g. polymeric) material formed to provide a surface finish similar to a conventional masonry brick. Other suitable materials for the slips 86 include resin-based materials, cementitious materials and composites/mixtures thereof. The slips 86 are relatively thin, and are mounted on planar backing boards or sheets 88, which define the internal wall facing surfaces 36 of the surface panels. The backing boards 88 may be cement particle boards (or 'plaster board'), but could be of any other suitable material including wood (or wood products such as fibreboard) and the like.

The method involves carrying out a finishing procedure to form a desired surface finish, following mounting of the surface panels 22 to 34 and 78 to 82 to the support elements 16, 18 and 20. In the illustrated embodiment, a surface finish material is applied to the intersection region or regions between adjacent support panels. Referring particularly to FIG. 9, and to the interface region 58 between surface panels 22 and 24, the finishing procedure involves applying a surface finish material to that and other intersection regions.

FIG. 11 shows a pre-formed surface finish arrangement 84, which may be a single pre-formed component, but typically comprises a plurality of further brick slips 90, which can be positioned so that they extend across the intersection region 58, straddling the adjacent surface panels 22 and 24. The slips 90 are positioned in the interface zones 70 and 72 of the panels 22, 24 (FIG. 5), effectively filling the interface zones with slips 90. All of the interface zones (e.g. 68 to 74) between adjacent surface panels are filled with such brick slips to provide the surface finish effect shown in FIG. 8. It will be understood that the interface zones 68 and 74, and indeed the interface zones of further surface panels, are interfaces between the panels and other parts or areas of the house 10, or indeed further buildings, rather than specifically between adjacent surface panels. When all the interface zones have been filled, a cement based material such as a mortar or grout is supplied into channels 91 between the slips 86 and 90, portions of such channels being shown in FIG. 9.

The illustrated method comprises a further step of securing each surface panel to at least one adjacent surface panel. For example and referring to FIGS. 9 and 10, the surface panel 22 is secured to the adjacent surface panel 24. To this end, the surface panels 22 and 24 (and indeed the further surface panels employed in the method) comprise at least one interface component which cooperates with the adjacent panel. Interface components 92 and 94 are shown in the drawings, on the respective surface panels 22 and 24. The interface components 92 and 94 are moveable from positions where they are out of cooperation with the adjacent surface panel 24, 22 and a position where they cooperate with said adjacent panel. These positions are shown respectively in FIG. 9 and FIG. 10.

The interface components 92 and 94 are deformable for movement between these positions, and to this end take the form of sheet or sheet-like components having a plurality of apertures (not shown). Typical suitable materials include meshes, which are preferably foldable to overlap the adjacent surface panel 22, 24 and which may suitably be of plastics, metal or metal alloy materials.

The interface meshes 92 and 94 are typically folded back to the positions shown in FIG. 9 prior to mounting of the surface panels 22 and 24, or may be provided folded over, and in particular folded back to overlie the brick slips 86. Following mounting of the surface panels 22 and 24 to the support elements 16, 18 and 20 (as appropriate), the interface meshes 92 on the surface panel 22 are folded to cover the interface zones 70 on the panel 22, and to extend across and cover part the interface zone 72 on the adjacent surface panel 24. It will be understood particularly from FIG. 5 that a plurality of such interface members 92 and 94 are provided, to take account of the staggered pattern of the brick slips 86 shown in this embodiment. However, different brick patterns may be employed which will not require the provision of separate interface components.

The interface mesh 94 on the surface panel 24 is then folded to overlie the interface mesh 92, as shown in FIG. 10. The brick slips 90 shown in FIG. 11 can then be applied over this arrangement of interface meshes 92 and 94, the slips 90 secured using an adhesive or cement-based material. The mesh structure of the interface meshes 92 and 94 provides a good key with the adhesive or cement-based material. A mortar or grout can then be provided in channels (not shown) between the brick slips 90 and slips 86 of the surface panels 22 and 24, to finish the surface effect. The overlapping meshes 92 and 94 are typically 'bedded' into the backing board 88 with bedding adhesive 'on site', which will be allowed to set prior to the application of adhesive for the brick slips 90, and indeed the slips themselves. Ideally, this involves a single adhesive application, both for bedding the meshes 92, 94 and securing the slips 90 in place.

The flowable insulation material 42 which is used to fill the cavity 40 may be one of a range of suitable flowable materials used in the building industry, such as for cavity wall insulation filling purposes. A typical suitable material comprises a large number of solid beads, pellets, granules or the like, indicated by numeral 93 in the drawings. These beads 93 typically have a time-setting coating such as an adhesive, which binds the beads together in the cavity 40. Insulation materials of this type are easily handled and supplied into the cavities 40. A particularly suitable insulation material is expanded polystyrene (EPS) beads.

It will be understood from the above and the accompanying drawings that the surface panels 22 to 34 and 78 to 82 have a length, height and shape, and that the length, height and/or shape of at least one surface panel may differ from the length, height and/or shape of at least one other surface panel. This is best shown in FIG. 7. The method comprises pre-forming the surface panels to have the required length, height and/or shape prior to mounting the panels to the support element 16, 18 and 20. Advantageously, this can be carried out off-site, following an assessment of the house 10, including the shape of its wall 12, and the location of any obstacles such as the window 52, door 53 and further windows 96 and 98. The surface panels 22 to 34, 78 to 82 are manufactured of the required length, height and/or shape off-site, to speed the installation process. In particular, the backing boards 88 are cut to the desired shape, and the brick slips 86 applied to the backing boards in a suitable number and pattern.

One further advantage of the retro-fit external insulation system of the present invention is that the various components of the system can be provided in a flat-pack kit comprising the surface panels 22 to 34, 78 to 82 of required shapes and the various support elements 16, 18 and 20. The insulation beads 93 are typically supplied in bulk form in a suitable container, ready for "blowing" into the cavities 40 using suitable handling equipment of a type known in the industry. Furthermore, the invention encompasses a kit of parts which can be arranged to form a retro-fit external insulation system for a building, and the kit of parts may comprise a group comprising a plurality of surface panels, the surface panels each having a length, a height and a shape (or profile), in which the length, height and/or shape of at least one surface panel differs from the length, height and/or shape of at least one other surface panel. Some (not all) of the surface panels may be selected from the group for mounting to the support elements. The group of panels may comprise a range of panels of length, height and/or shape suited to a wide range of buildings, so that panels appropriate to the building in question can be selected for covering said part of the existing external surface of the wall.

Figure 12:
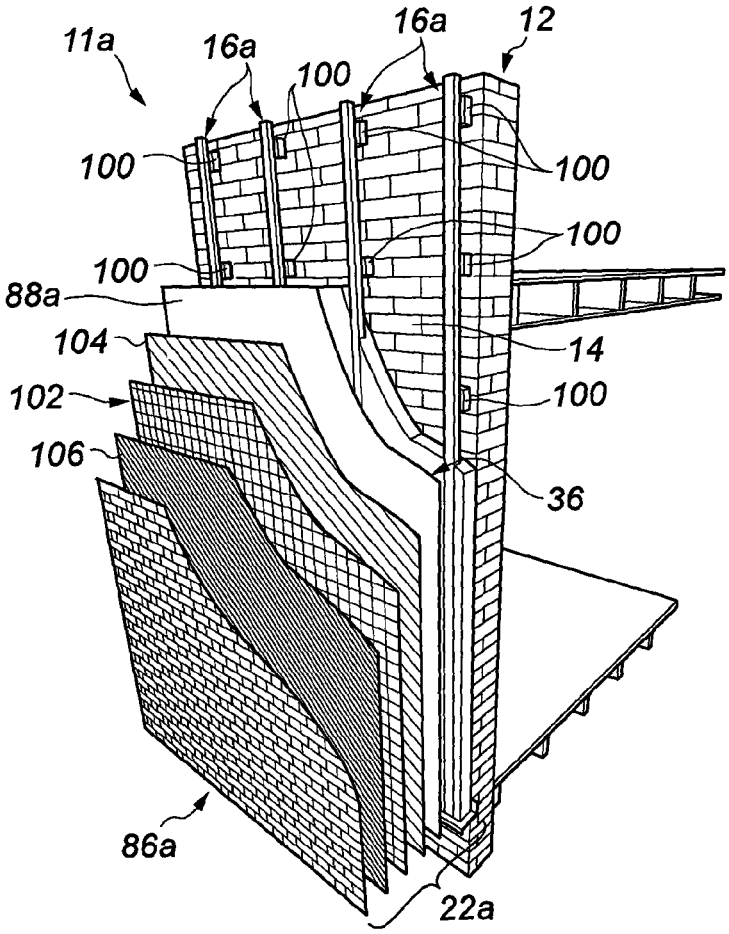
FIG. 12 is an exploded perspective view of a retro-fit external insulation system according to another embodiment of the present invention.

Turning now to FIG. 12, there is shown an exploded perspective view of a retro-fit external insulation system according to another embodiment of the present invention, the system indicated generally by reference numeral 11*a*. Like components of the system 11*a* with the system 11 of FIGS. 2 to 11 share the same reference numerals, with the addition of the suffix 'a'.

The system 11*a* is in-fact of similar structure to the system 11, and indeed installed in a similar way, differing primarily in terms of support elements 16*a* of the system. Specifically, in this embodiment, the support elements 16*a* are again elongate members such as beams, slats or spacers. However, the elongate members 16*a* are coupled to a plurality of support pads, blocks or the like, indicated by numeral 100. The pads 100 are spaced apart along a length direction of the elongate members 16*a*. The elongate members 16*a* can be provided integrally with the support pads 100, or separately and subsequently coupled together, either on or off site. Typically, the pads 100 will be of a similar material to the elongate members 16*a*. The support pads 100 contact and are secured to the existing external surface 14 of the wall 12, using suitable fixings (not shown). The surface panels 22*a* are therefore mounted to the wall surface 14 via the elongate members 16*a* and the pads 100. Advantageously, the support pads 100 provide a reduced area of contact with the existing external surface 14 of the wall 12, and so reduced heat transfer from the wall. In a variation on this embodiment, the elongate members 16*a* may be dispensed with, so that the support pads 100 directly contact the wall-facing surfaces 36 of the surface panels 22*a*.

FIG. 12 also shows further parts of the system 11*a*, and indeed steps in the associated method, which may also apply to the system 11 of FIGS. 2 to 11. In particular, a decorative surface finish comprising brick slips 86*a* are provided in sheet-form, and an intermediate, reinforcing component in the form of a mesh 102 is provided between the sheet of brick slips 86*a* and a backing sheet 88*a*. The mesh 102 is suitably of a plastics, metal or metal alloy material, and is bonded to the backing sheet 88*a* using adhesive 104. The mesh 102 provides a good key for bonding the sheet of brick slips 86*a* to the backing sheet 88*a*, via a further adhesive 106 (although it may be possible to use a single layer of adhesive to both bond the mesh 102 to the backing sheet 88*a*, and the sheet of brick slips 86*a* to the backing sheet, via the mesh).

In a variation, the reinforcing component (mesh 102) may be provided integrally with the decorative surface finish component (the sheet of brick slips 86*a*). This may be achieved by embedding the mesh 102 into a rear of the sheet of brick slips 86*a*, which may be facilitated where the slips are of a moulded or similarly formed material, such as a plastics material where, e.g. the slips can be formed by extruding the plastics material over the mesh.

Suitably and whether or not the reinforcing component (mesh 102) is provided integrally with the decorative surface finish component (the sheet of brick slips 86*a*), the surface finish component may be coupled to the backing sheet 88*a* using a cement-based material, such as a mortar. Apertures may be provided in the sheet of brick slips 86*a*, suitably in the grout lines between slips, so that the mortar squeezes through apertures in the mesh 102 and into the grout line areas during fitting to the backing sheet 88*a*. In this way, the mortar can be used both to secure the sheet of brick slips 86*a* to the backing sheet 88*a*, and also to at least partially fill the grout lines, which can be subsequently smoothed to a desired finish. This may avoid a requirement to separately supply mortar/grout into the grout lines.

Figure 13:
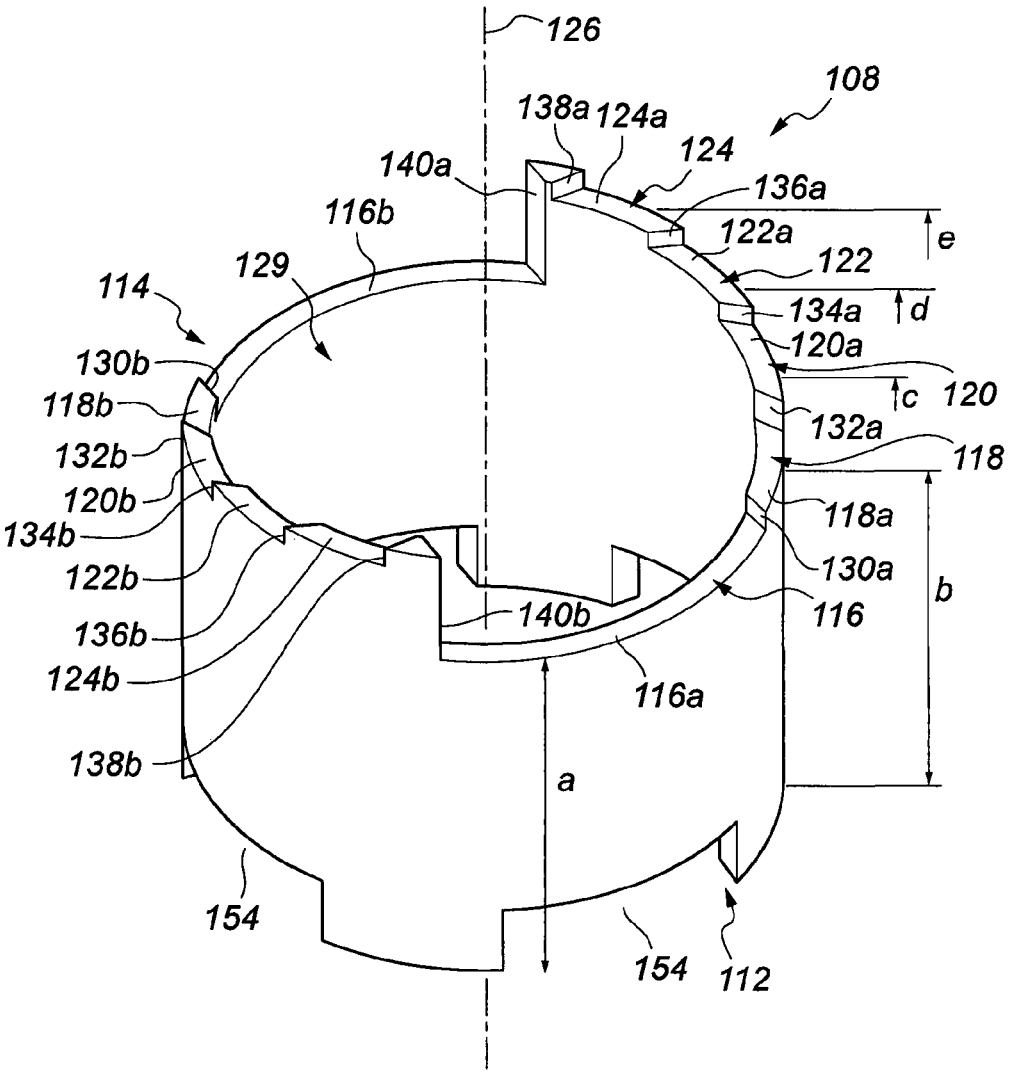
FIG. 13 is a perspective view of an adjustable spacer, in accordance with an embodiment of the present invention, which has a use in the method and system of FIGS. 2 to 12.
Figure 14:
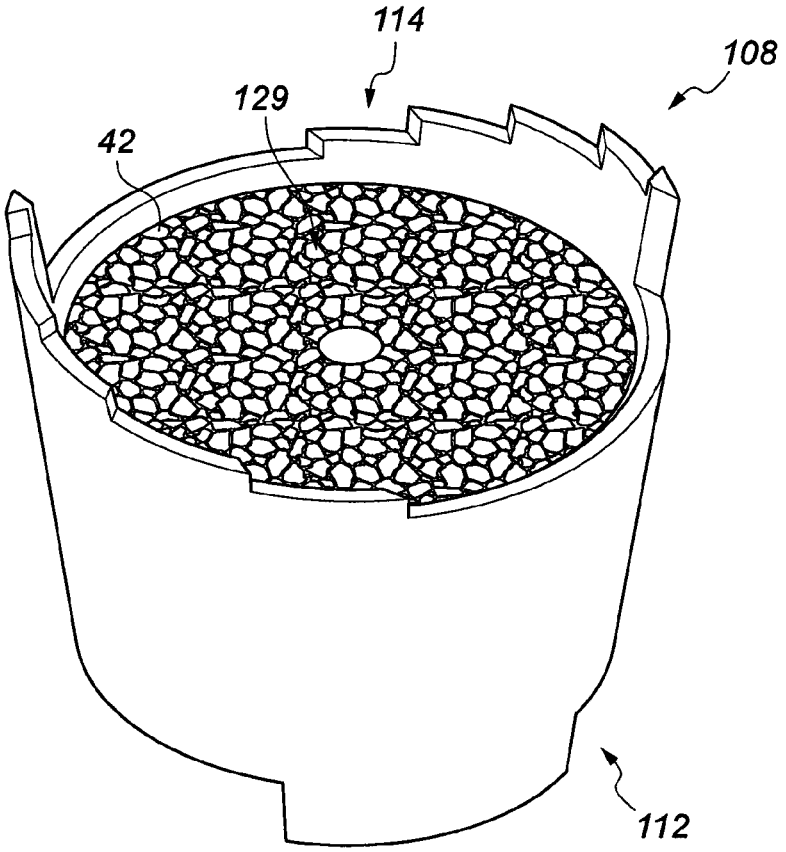
FIG. 14 is a view of the adjustable spacer which is similar to FIG. 13, showing the spacer containing flowable insulation material.

Turning now to FIG. 13, there is shown a perspective view of an adjustable spacer, in accordance with an embodiment of the present invention, which has a use in the method and system of FIGS. 2 to 12. The spacer is indicated generally by reference numeral 108, and is also shown in FIG. 14, which is a view similar to FIG. 13, but showing the spacer containing flowable insulation material 42.

Figure 17:
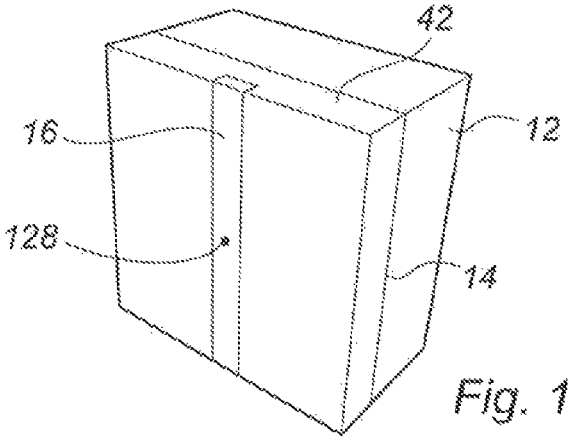
FIGS. 15 to 17 are perspective views showing further steps in a method of retro-fitting an external insulation system, and a retro-fit external insulation system, employing the adjustable spacer of FIG. 13.
Figure 16:
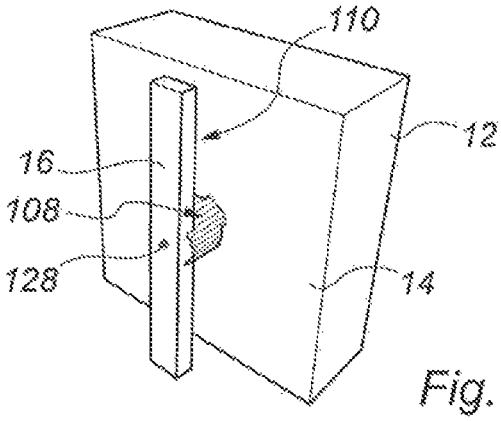
Figure 15:
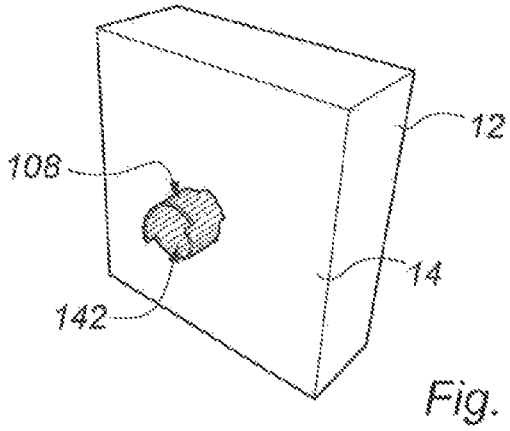

The spacer 108 is for mounting an elongate building element to a surface so that a space is defined between the building element and the surface. In the illustrated embodiment, in which the spacer is used in the method and system of FIGS. 2 to 12, the building element is the support element 16, whilst the surface is the existing external surface 14 of the building 10. This is shown in FIGS. 15 to 17, which are perspective views of the spacer 108 illustrating further, optional steps in the method and system of FIGS. 2 to 12. The space is indicated by numeral 110, shown in FIG. 16, and is the space between the support element 16 and the external surface 14.

The spacer 108 is adjustable to vary a dimension of the space 110, and comprises a first end 112 adapted to abut the surface 14, and a second end 114 adapted to abut the support element 16. The second end comprises a first mounting face 116 which is at a first distance 'a' from the first end 112 of the spacer 108, and a second mounting face 118 which is at a second distance 'b' from the first end 112 of the spacer, the second distance being greater than the first distance. The spacer 108 is adjustable between a first configuration in which the first mounting face 116 is arranged to abut the support element 16, and a second configuration in which the second mounting face 118 is arranged to abut the support element 16, so that the space 110 between the support element 16 and the surface 14 can be adjusted.

The spacer 108 is a one-piece spacer, which facilitates positioning of the spacer (compared to prior such spacers) and indeed assembly of the system 11, as will be described below. The spacer 108 is preferably of a material having insulating properties. Suitable materials include plastics materials, such as a Polycarbonate material. The spacer 108 may be of a material having a relatively low heat transfer coefficient, which may be no more than about 0.20 W/(mK).

The second end 114 of the spacer 108 actually comprises a plurality of further mounting faces, numbered respectively 120, 122 and 124, each of which is at a respective further distance 'c', 'd' and 'e' from the first end 112 of the spacer than the preceding mounting face. The spacer 108 is adjustable between the first configuration, the second configuration, and any one of a plurality of further configurations in which a respective one of the further mounting faces 120 to 124 is arranged to abut the support element 16.

In the illustrated method and system, the adjustable spacer 108 is used to mount the support element 16 to the building surface 14. The step of mounting the support elements 16 to the surface 14 comprises positioning at least one (and typically a plurality) of the adjustable spacers 108 between each support element 16 and the surface 14, and adjusting the spacer 108 to vary the space 110 between the support element 16 and the surface 14. Mounting the support elements 16 to the surface 14 using the spacers 108 facilitates adjustment of the space 110 to accommodate one or more of: variations in the external surface 14 (e.g. where portions of the surface are not in a common plane); variations in dimensions of the surface panels 22 and/or the support elements 16; and variations in a fit of the surface panels 22 and/or support elements 16 to each other and/or to the surface 14. The spacers 108 can also facilitate adjustment of a dimension of the cavities 40.

The mounting faces 116 to 124 of the spacer 108 in fact comprise a plurality of mounting face portions which together define the mounting face. The mounting face portions are discrete, and given the numerals 116*a/b*, 118*a/b*, 120*a/b*, 122*a/b* and 124*a/b*, respectively. The mounting faces 116 to 124 are spaced around a periphery of the spacer 108 at the second end 114. As can be seen, the spacer 108 is hollow, being of a generally cylindrical tubular shape, and the mounting faces 116 to 124 are spaced around a circumference of the spacer at the second end 114.

The mounting faces 116 to 124 are defined by supports, which take the form of ledges, shelves or the like. The ledges 116*a/b* to 124*a/b* forming each mounting face 116 to 124 are arranged transverse to a main axis 126 of the spacer 108 (extending between the first and second ends 112, 114), and in the illustrated embodiment are arranged substantially perpendicularly to the main axis. The ledges 116*a/b* to 124*a/b* of each mounting face 116 to 124 are arranged on a line passing through a centre of the spacer 108, and so effectively arranged across a diameter of the spacer.

The ledges 116*a/b* to 124*a/b* of each mounting face 116 to 124 are also provided at common distances 'a' to 'e' from the first end 112 of the spacer 108, and cooperate to define an abutment for the support elements 16. This is best shown in FIGS. 15 to 17. FIG. 15 shows a spacer 108 positioned on the external wall surface 14. A support element 16 is introduced to the spacer 108, and positioned in abutment with the ledges 116*a/b* forming the first mounting surface 116. In this way, the support element 16 is effectively located at the first distance 'a' from the wall surface 14. Effectively, the spacer 108 defines a channel, slot or the like 142 (FIG. 15) at the second end, which receives the support element 16, and which restricts relative rotation between the spacer and the support element. The support element 16 and spacer 108 are then secured to the wall 12 using a suitable anchor or fixing 128, which passes through an interior cavity 129 of the spacer 108 and into the wall. Surface panels 22 (not shown in these Figs.) are then secured to the support element 16, and flowable insulation material 42 supplied into the cavities which are defined between the surface panels 22 and the wall surface 14.

The spacer 108 is thus clamped between the support element 16 and the wall surface 14, via the anchor 128, which passes through the support element and the spacer into the wall 12. The spacer 108 provides a substantially uniform distribution of load on the wall 12, during use, due to its hollow, cylindrical tubular shape.

If it is desired to adjust the spacer 108, to account e.g. for variations in a dimension of the space 110, then the spacer can be adjusted between its different configurations by rotating it about its main axis 126, so that a different mounting face selected from the faces 118 to 124 can be chosen for abutting the support element 16. For example, a variation in the wall surface 14 may be such that the dimension of the space is equivalent to the dimension 'c' defined by the mounting face 120. The spacer 108 may thus be rotated to bring the ledges 120*a/b* defining the mounting face 120 into a position where they can abut the support element 16.

The spacer 108 also comprises restraints for restraining rotation of the spacer relative to the support element 16, each of which extend in a direction which is generally parallel to the main axis 126 of the spacer. A number of pairs of restraints 130*a/b*, 132*a/b*, 134*a/b*, 136*a/b* and 140*a/b* are provided, which are arranged to cooperate with lateral sides or edges of the support element 16. The restraints 130*a/b* to 140*a/b* cooperate with a respective ledge of one of the mounting faces 116 to 124, so that they together define a channel, slot, recess or the like for receiving the support element 16. The restraints 130*a/b* to 140*a/b* restrain rotation of the spacer 108 relative to the support element 16, whilst the mounting faces 116 to 124 support the element 16 at the respective distance 'a' to 'e' from the first end 112 of the spacer. For example and as shown in FIGS. 15 to 17, the spacer 108 is positioned in its first configuration, in which the ledges 116*a/b* of the first mounting face 116 are arranged to receive and abut the support element 16. The support element 16 is effectively seated on the ledges 116*a/b* at the distance 'a' from the wall surface 14, and rotation of the spacer 108 is restricted by the restraints 130*a/b* (and 140*a/b*) which, together with the ledges, effectively define a channel 142 (FIG. 15) which receives the support element 16.

Figure 18:
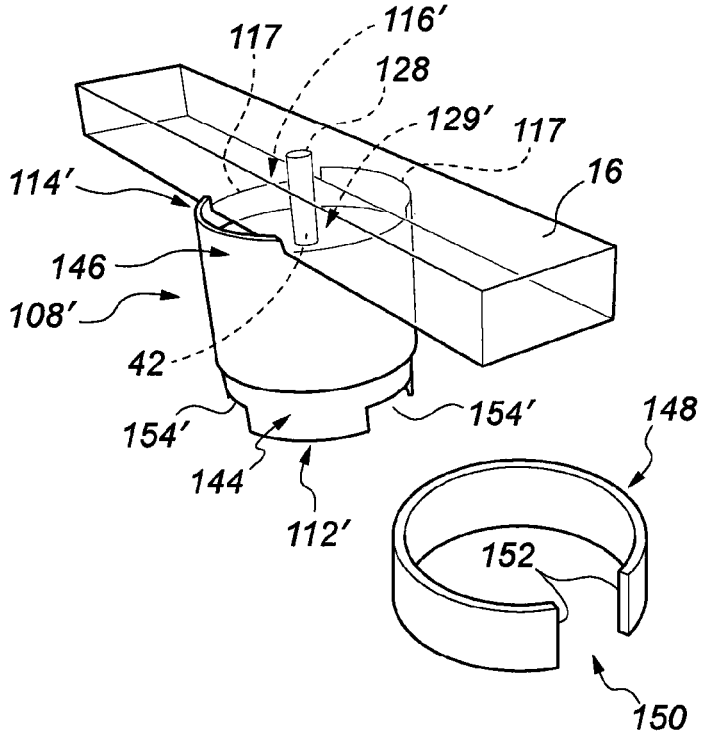
FIG. 18 is a perspective view of an adjustable spacer in accordance with another embodiment of the present invention, shown in a partially assembled state, the spacer having a use in the method and system of FIGS. 2 to 12.

Turning now to FIG. 18, there is shown a perspective view of an adjustable spacer, in accordance with another embodiment of the present invention, which has a use in the method and system of FIGS. 2 to 12. The spacer is indicated by reference numeral 108'. Like components of the spacer 108' with the spacer 108 of FIG. 13 share the same reference numerals, with the addition of the suffix '.

Figure 19:
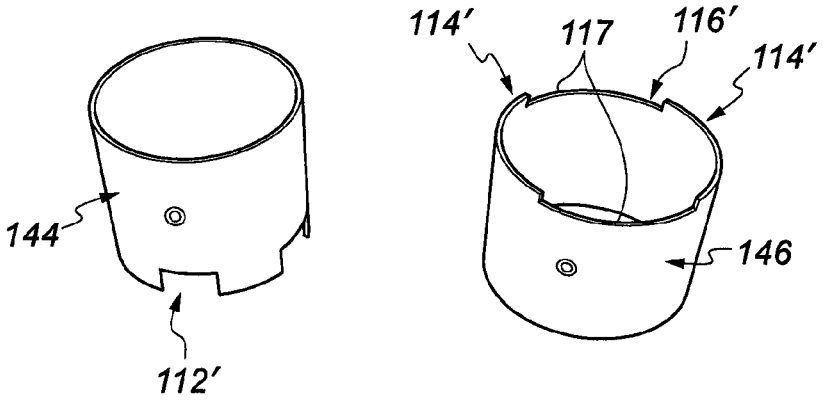
FIG. 19 is a perspective view of first and second spacer components forming part of the spacer shown in FIG. 18.

In this embodiment, the adjustable spacer 108' comprises a first spacer component 144 defining a first end 112' of the spacer, which is adapted to abut the external wall surface 14. The spacer 108' also comprises a second spacer component 146 defining a second end 114' of the spacer. The spacer components 144 and 146 are shown separately in FIG. 19. The second end of the second spacer component 146 comprises a mounting face 116' which is adapted to abut the support element 16. The mounting face 116' is defined by two ledges or shelves 117, which together effectively form a channel or slot that receives the support element 16.

The first and second spacer components 144, 146 are movably coupled so that a distance between the first end 112' and the mounting face 116' of the second end 114' can be varied, to adjust the space 110 (FIG. 16) between the support element 16 and the surface 14. The spacer 108' also comprises a restraining component 148 for selectively restraining movement of the second spacer component 146 relative to the first spacer component 144 in a direction towards the first end 112', to fix the distance between the first end and the mounting face 116' of the second end 114', and so a dimension of the space 110.

Typically, one of the first and second spacer components 144 and 146 is a female component and the other a male component, the female component being shaped to receive the male component in a sliding fit. In the illustrated embodiment, the first component 144 is a male component and the second component 146 is a female component. The restraining component 148 is positioned around one of the spacer components 144 and 146, and arranged to abut the other one of the spacer components, to thereby restrain movement of the other spacer component. The restraining component 148 is adapted to be provided at the first end 112' of the spacer 108', and to abut the second spacer component 146 and the wall surface 14.

Figure 20:
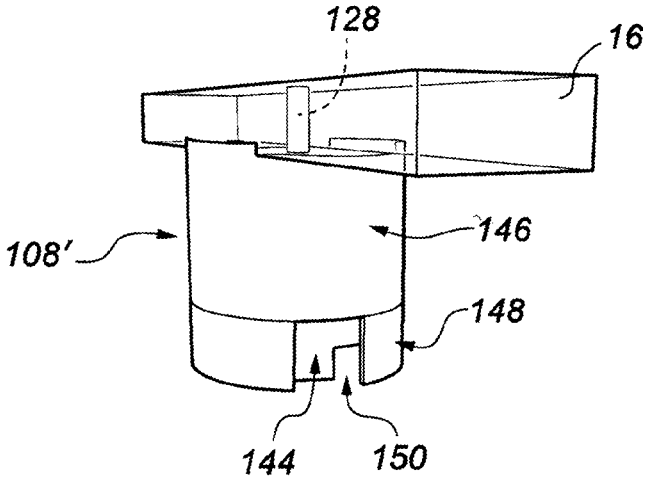
FIG. 20 is a perspective view of the spacer of FIG. 18 in a fully assembled state.

The restraining component 148 is shaped to fit around one of the spacer components, in this embodiment the first spacer component 144. This is shown in FIG. 20. The restraining component 148 is elastically deformable for engagement around the first spacer component 144, and is typically a sprung component. The restraining component 148 suitably takes the form of a shim, collar, cuff or the like, and may in particular be split, in the general shape of a split-ring, comprising a gap 150 defined between circumferential edges 152 of the ring, the ring being elastically deformable so that the gap can be expanded to fit the ring around the first spacer component 144.

Typically, the restraining component 148 is cut to the required length, to suit the dimensions of the space 110 which the spacer 108' is required to bridge. However, the spacer 108' may comprise a plurality of restraining components 148 (not shown), each having a respective length in a direction along a main axis 126' of the spacer (extending between the first and second ends 112', 114'). In this way, a spacer 108' of a desired length may be formed, for defining a desired distance between the first end 112' of the spacer and the mounting face 116' of the second end 114'.

Each of the spacers 108 and 108' disclosed herein are hollow, defining an internal cavity 129/129' which extends between its first and second ends. As discussed above, the internal cavity can receive flowable insulation material 42, which may be charged into the cavity prior to installation on the wall surface 14, or when the material is supplied into the cavities 40. The internal cavity can also receive the anchor 128 used to secure the support element 16 to the surface 14. The spacer 108' may include an aperture in the mounting face 116' through which the anchor 128 can pass. The spacers 108/108' also comprise at least one aperture 154, 154' extending through a side wall of the spacer, the aperture(s) communicating with the internal cavity 129, 129'. This facilitates the flow of insulation material 42 into/out of the cavity 129, 129'. At least one such aperture 154, 154' may be provided at/adjacent the first end 112, 112' of the spacer 108, 108'.

Whilst the adjustable spacers have been described as forming part of the method/system/kit disclosed herein, it will be understood that they may be employed in other methods, systems and kits. The elongate building element may be any desired building element. The building element may be a support element for mounting a surface panel to an external surface of a wall of a building, such as is employed in the present method/system/kit. However, the building element may be a joist, beam or other element used for supporting a roof, floor, deck or the like on or from the surface. Indeed, the surface may be any suitable surface and is not restricted to a wall, and may be a roof or floor (internal or external).

Figure 21:
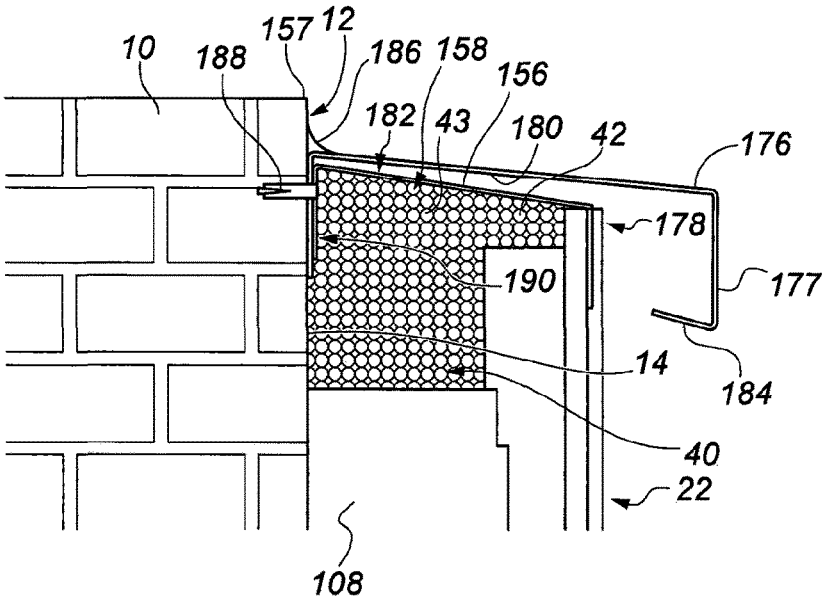
FIG. 21 is an enlarged side view of part of the building shown in FIG. 1, illustrating optional further steps in the method, and optional further features of the system, of FIGS. 2 to 12.

Turning now to FIG. 21, there is shown an enlarged side view of part of the building 10 shown in FIG. 1, illustrating optional further steps in the method, and optional further features of the retro-fit insulation system 11, of FIGS. 2 to 12. Whilst the further steps/features are described with particular reference to the method and system 11 of FIGS. 2 to 12, it will be understood that the further steps/features have a use in all of the methods/systems disclosed in this document. In particular, the further steps/features may form part of a method/system employing an adjustable spacer, as shown and described in FIGS. 13 to 20.

FIG. 21 shows a top or upper barrier member 156 which closes the tops of at least some of the cavities 40, typically those which are uppermost, adjacent a top 157 of the wall 12. One such cavity 40 is shown in the drawing, and has a top 158. The top barrier member 156 prevents the insulation material 42 from flowing out of the tops 158 of cavities 40 adjacent the top 157 of the wall 12, particularly where the insulation takes the form of beads or pellets (as shown in the drawing). The top barrier member 156 is arranged so that it allows water vapour to escape from the cavities 40, typically by means of a plurality of apertures (not shown). This is advantageous in that it allows any water vapour which has entered the cavities 40 through the building wall 12 to pass up and out of the cavities, reducing the risk of the vapour condensing and becoming trapped within the cavities. This may be achieved by providing a top barrier member 156 formed from a flexible material, which may be a flexible mesh-type material. This may provide the advantage that the top barrier member 156 can flex to accommodate the flowable insulation material 42 supplied into the cavities 40, which may cause the barrier member to flex outwardly. Alternatively, the top barrier member can be formed from a solid strip or sheet provided with apertures.

Typically, a single top barrier member 156 will be provided extending across the width of the building wall 12, although multiple barrier members may be provided in appropriate/desired circumstances. The top barrier member 156 is arranged so that it restricts liquid water from entering the cavities 40. This is achieved by providing apertures which are sized to permit the passage of water vapour but to restrict the passage of liquid water. The skilled person will readily appreciate the size of apertures required to achieve this. Where the top barrier member 156 is of a flexible material, suitable materials include plastics materials such as PVC.

Figure 22:
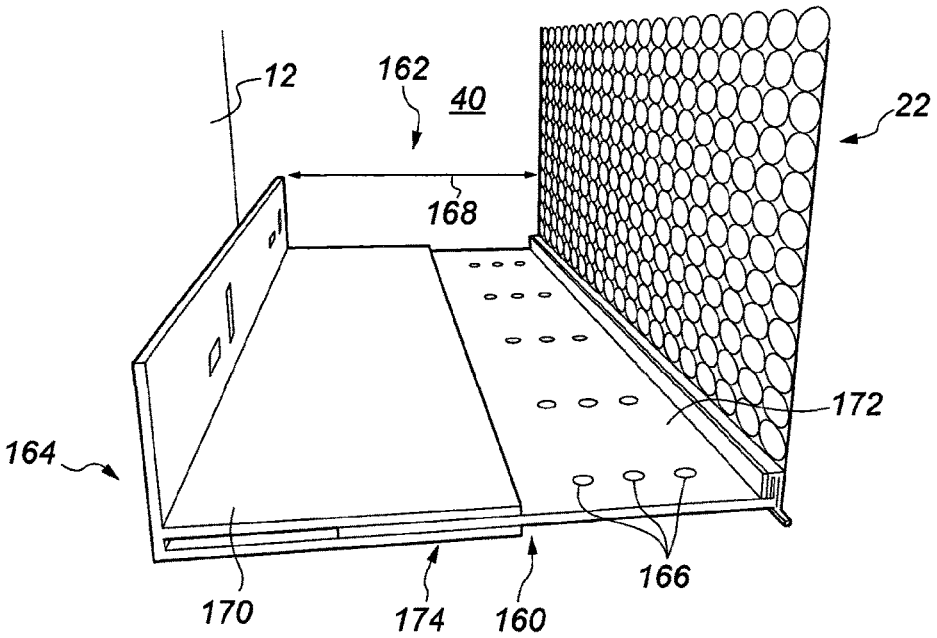
FIG. 22 is perspective view of a bottom barrier member, employed in an optional further step in the method, and forming an optional further feature of the system, of FIGS. 2 to 12.

Turning now to FIG. 22, there is shown a perspective view of a lower barrier member 160, which closes the bottoms of at least some of the cavities 40. Again, one such cavity 40 is shown in the drawing, and has a bottom 162. The bottom barrier member 160 prevents the insulation material 42 from flowing out of the bottoms 162 of lowermost cavities 40, adjacent a bottom 164 of the wall 12, particularly where the insulation takes the form of beads or pellets. The bottom barrier member 160 is arranged so that it allows liquid water to escape from the cavities 40. This is advantageous in that it allows any liquid water within the cavities 40, such as rainwater or condensed water vapour, to drain out. This is achieved by providing the bottom barrier member 160 with a plurality of apertures 166. Typically, a single bottom barrier member 160 will be provided extending across the width of the building wall 12, although multiple barrier members may be provided in appropriate/desired circumstances.

The flow of water vapour and/or liquid water out of the cavities 40 is facilitated by selecting a suitable insulation material 42. The use of an insulation material comprising a plurality of particles of a solids material, such as beads, pellets or granules 43, is particularly beneficial. This is because a plurality of channels are defined between the beads 43, through which liquid water can pass to the bottom barrier member 160 and so exit the cavities 40, and through which water vapour can pass to the top barrier member 156 and so similarly exit the cavities.

In the illustrated embodiment, at least one dimension of the bottom barrier member 160 is adjustable. The dimension is a depth of the barrier member, taken in a direction between the panels (the panel 22 being shown in the drawing) and the wall 12, as indicated by the line 168. This provides the ability to accommodate cavities 40 of different dimensions (depths). To achieve this, the bottom barrier member 160 comprises a first part 170 which is mountable on the external surface 14 of the wall 12, and a second part 172 which is mountable to at least some of the panels (or vice-versa). The second part 172 is shown mounted to the panel 22. The first and second parts 170, 172 are coupled together so that they are movable relative to one-another, to vary the depth 168 of the barrier member 160. This may be achieve in numerous ways, but suitably can be achieved employing a sliding arrangement, such as a tongue-and-groove arrangement, as shown at 174 in the drawing.

FIG. 21 also shows a cover member 176, which is positioned over the top barrier member 156, and which prevents liquid water (e.g. rainwater) from falling on to the upper barrier member. Typically, the cover member 176 will be positioned below a gutter (not shown) located adjacent the edge of a roof (not shown) of the building 10, to catch rainwater falling from the roof. To this end, the cover member 176 is impermeable to liquid water. A single cover member 176 may be provided extending across the width of the building wall 12, although multiple cover members may be provided in appropriate/desired circumstances.

The cover member 176 is also shaped to define a wind guard 177 which overlaps tops of the panels, a top 178 of the panel 22 being shown in the drawing. This helps to prevent rainwater from being blown back on to the top barrier member 156. The cover member 176 defines a lower surface 180 which faces towards an upper surface 182 of the top barrier member 156. The lower surface 180 facilitates condensation of water vapour escaping from the cavities 40, and so forms a condensing surface. The cover member 176, in particular the lower surface 180, is arranged so that it is inclined relative to the horizontal and/or the top barrier member 156, to facilitate the flow of water which has condensed on the surface 180 off the cover member. Drainage holes (not shown) may be provided in a lower portion 184 of the wind guard, for drainage of collected water.

Typically, a sealant material 186 is applied to the wall 12 in the region where the cover member 176 is to be mounted, via a securing bolt 188. When the bolt 188 is tightened, it squeezes sealant 186 upwards, which can then be shaped to seal an interface between the wall 12 and the cover member 176, as shown in the drawing. Further sealant can 186 be applied at the intersection, if required. The bolt 188 also serves for clamping a mounting member for the top barrier mesh 156 to the wall 12, which may be a mounting plate and which may be provided integrally or coupled to the mesh. Suitably, an insulating member such as a plate (not shown) may be located between the cover member 176 and the mounting plate 190, to reduce or avoid formation of a cold-bridge.

Various modifications may be made to the foregoing without departing from the spirit or scope of the present invention.

For example, the decorative surface finish may be a cement-based surface finish effect, such as a surface render, roughcast/pebbledash, stucco or plaster.

The surface panels may comprise a backing sheet or board forming the internal wall-facing surface, and a decorative surface component forming at least part of the external surface of the panel. The decorative surface component may be provided integrally with the backing sheet or may be applied subsequently.

The finishing procedure may comprise applying a surface finish material to a substantial part of (and optionally all of) the external surfaces of the surface panels. This step may comprise applying a cement-based surface finish material to the external surfaces of the panels. The cement-based surface finish material may be a surface render, roughcast/pebbledash, stucco, plaster or the like.

The flowable insulation material may be a time-setting fluid or gel-based material, for example a foam. The flowable insulation material may be a fibrous material, in particular a chopped fibre type insulation. As is known in the industry, this comprises a large number of short, lightweight fibres which can be blown into the cavities (and so are 'flowable'). Combinations of different flowable insulation materials may be employed.

Any other suitable material can be used for the support elements, including wood-based materials such as MDF or chipboard, or plastics materials. The support elements may be arranged so that they are substantially horizontally oriented, spaced apart across a height dimension of the wall. Vertically and horizontally oriented elements may be employed, and/or potentially transversely oriented elements. Vertical orientation is preferred though as this eases supply of the insulation into the cavities, under the action of gravity.

One or more panel may be coupled to one or more other panel in such a way that it is not necessary to mount said panel to a support element. Said panel may effectively be supported by an adjacent panel or panels.

The step of mounting the support elements to the external surface may comprise: positioning at least one adjustable spacer between at least some of the support elements and the panels, optionally between each support element and a respective panel or panels, the spacer comprising a first end which abuts the panel and a second end which abuts the support element; and adjusting the spacer to vary a space between the support element and the panel. The system/spacer may be correspondingly arranged.

The invention claimed is:

1. A method of retro-fitting an external insulation system to a building, the method comprising the steps of:

mounting a plurality of support elements to an existing external surface of a wall of a building;

providing a plurality of surface panels, each of which comprises an internal wall-facing surface and an external surface;

arranging the surface panels so that they cover at least a substantial part of the existing external surface of the wall;

mounting each surface panel to one or more of the support elements, so that cavities are defined between the internal wall-facing surfaces of the panels and the existing external surface of the wall; and supplying flowable insulation material into the cavities;

in which the step of mounting the support elements to the external surface of the wall comprises:

positioning at least one adjustable one-piece spacer between each support element and the external surface of the wall, the spacer comprising:

a first end adapted to abut the external surface of the wall;

a second end adapted to abut the support element;

a main axis extending in a direction between the first and second ends;

a first mounting face which is at a first distance from the first end of the spacer; and a second mounting face which is at a second distance from the first end of the spacer, the second distance being greater than the first distance;

adjusting the spacer between a first configuration in which the first mounting face abuts the support element, and a second configuration in which the second mounting face abuts the support element, by rotating the spacer relative to the support element about the main axis, to vary a space between the support element and the external surface of the wall;

clamping the adjustable spacer between the support element and the external surface of the wall; and passing a fixing through the support element and the spacer into the wall to clamp the spacer.

2. A method as claimed in claim 1, wherein adjusting the spacer comprises rotating the spacer about a main axis extending in a direction between the first and second ends.

3. A method as claimed in claim 1, further comprising arranging the adjustable spacer so that the spacer provides a substantially uniform distribution of load on the wall, during use.

4. A method as claimed in claim 1, wherein the second end of the spacer comprises a first mounting face which is at a first distance from the first end of the spacer, and a second mounting face which is at a second distance from the first end of the spacer, the second distance being greater than the first distance, and wherein the step of mounting the support elements to the external surface of the wall comprises adjusting the spacer between:

a first configuration in which the first mounting face abuts the support element; and a second configuration in which the second mounting face abuts the support element, to thereby adjust the space between the support element and the external surface of the wall.

5. A method as claimed in claim 4, wherein the second end of the spacer comprises at least one further mounting face which is at a further distance from the first end of the spacer, the further distance being greater than the second distance, and wherein the step of mounting the support elements to the external surface of the wall comprises adjusting the spacer into at least one further configuration in which the further mounting face abuts the support element.

6. A method as claimed in claim 4, comprising adjusting the spacer between the first and second configurations by rotating the spacer about a main axis extending in a direction between the first and second ends.

7. A method as claimed in claim 1, comprising closing tops of at least some of the cavities using at least one top barrier member, and arranging said top barrier member so that the top barrier member allows water vapor to escape from the cavities;

closing bottoms of at least some of the cavities using at least one bottom barrier member, and arranging said bottom barrier member so that the bottom barrier member allows liquid water to escape from the cavities; and arranging the flowable insulation material so that liquid water in the cavities can pass through the flowable insulation material to said bottom barrier member and so exit the cavities, and so that water vapor in the cavities can pass through the flowable insulation material to said top barrier member and so exit the cavities.

8. A method as claimed in claim 7, wherein the step of supplying flowable insulation material into the cavities comprises supplying a plurality of particles of a solid insulating material into the cavities, and arranging the solid insulation material so that a plurality of channels are defined within the solid insulating material, through which liquid water and water vapor can pass.

9. A method as claimed in claim 7, comprising positioning at least one cover member over said top barrier member, to prevent liquid water from falling on to the barrier member, the at least one cover member defining a lower condensing surface, and the method further comprising arranging said cover member so that the lower condensing surface faces towards an upper surface of the at least one top barrier member, water vapor exiting the cavities condensing on the lower condensing surface.

10. A retro-fit external insulation system for a building, comprising:

a plurality of support elements, the support elements being mountable to an existing external surface of a wall of a building;

a plurality of surface panels, each of which comprises an internal wall-facing surface and an external surface; and a flowable insulation material;

in which the plurality of surface panels are adapted to cover at least a substantial part of the existing external surface of the wall;

and in which the surface panels are each adapted to be mounted to one or more of the support elements, so that cavities are defined between the internal wall-facing surfaces of the panels and the existing external surface of the wall, into which the flowable insulation material can be supplied;

and in which the system further comprises a plurality of adjustable one-piece spacers, each spacer being adapted to be positioned between a support element and the external surface of the wall, the spacers comprising:

a first end adapted to abut the external surface of the wall;

a second end adapted to abut the support element;

a main axis extending in a direction between the first and second ends;

a first mounting face which is at a first distance from the first end of the spacer; and a second mounting face which is at a second distance from the first end of the spacer, the second distance being greater than the first distance;

wherein the spacers are each adjustable between a first configuration wherein the first mounting face abuts the support element, and a second configuration wherein the second mounting face abuts the support element, by rotation relative to the support element about the main axis, to vary a space between the support element and the external surface of the wall; and fixings for clamping the adjustable spacers between the support element and the external surface of the wall, each fixing adapted to pass through the support element and one of the spacers into the wall.

11. A system as claimed in claim 10, wherein the adjustable spacers provide a substantially uniform distribution of load on the wall, during use.

12. A system as claimed in claim 10, wherein each of the spacers is of a generally cylindrical tubular shape.

13. A system as claimed in claim 10, wherein the second end of each of the spacers comprises a first mounting face which is at a first distance from the first end of the spacer, and a second mounting face which is at a second distance from the first end of the spacer, the second distance being greater than the first distance, and wherein each of the spacers is adjustable between:

a first configuration wherein the first mounting face abuts the support element; and a second configuration wherein the second mounting face abuts the support element, to thereby adjust the space between the support element and the surface.

14. A system as claimed in claim 13, wherein the second end of each spacer comprises at least one further mounting face which is at a further distance from the first end of the spacer, the further distance being greater than the second distance, and wherein each of the spacers is adjustable into at least one further configuration wherein the further mounting face abuts the support element.

15. A system as claimed in claim 13, wherein the first and second mounting faces of each spacer comprises a plurality of mounting face portions which together define the respective mounting face.

16. A system as claimed in claim 13, wherein the first and second mounting faces are spaced around a periphery of the spacer at the second end.

17. A system as claimed in claim 13, wherein each of the spacers is of a generally cylindrical tubular shape, and wherein the first and second mounting faces are spaced around a circumference of the spacer at the second end.

18. A system as claimed in claim 13, wherein the first and second mounting faces are defined by at least one support arranged transverse to a main axis of the spacer.

19. A system as claimed in claim 18, wherein each of the first and second mounting faces is defined by a plurality of supports which together define the respective mounting face.

20. A system as claimed in claim 10, comprising restraints for restraining rotation of each of the spacers relative to the support element.

21. A system as claimed in claim 20, wherein the restraints are arranged to cooperate with lateral sides of the support element.

22. A system as claimed in claim 20, wherein a pair of the restraints cooperate with a mounting face to define a channel for receiving the support element.

23. A system as claimed in claim 10, comprising:

at least one top barrier member; and at least one bottom barrier member;

in which the at least one top barrier member is adapted to close tops of at least some of the cavities, and to allow water vapor to escape from the cavities;

in which the at least one bottom barrier member is adapted to close bottoms of at least some of the cavities, and to allow liquid water to escape from the cavities;

and wherein the insulation material is adapted to permit liquid water in the cavities to pass through the material to said bottom barrier member and so exit the cavities, and to permit water vapor in the cavities to pass through the material to said top barrier member and so exit the cavities.

24. A system as claimed in claim 23, wherein said top barrier is adapted to restrict liquid water from entering the cavities, comprising a plurality of apertures sized to permit the passage of water vapor but to restrict the passage of liquid water.

25. A system as claimed in claim 23, comprising at least one cover member which can be positioned over said top barrier member, wherein said cover member defines a lower surface, and is adapted to be arranged so that the lower surface faces towards an upper surface of the at least one top barrier member, the lower surface forming a condensing surface to facilitate condensation of water vapor escaping from the cavities.

26. A system as claimed in claim 10, wherein external surfaces of the panels form a decorative surface finish.

27. A method of retro-fitting an external insulation system to a building, the method comprising the steps of:

mounting a plurality of support elements to an existing external surface of a wall of a building;

providing a plurality of surface panels, each of which comprises an internal wall-facing surface and an external surface;

arranging the surface panels so that they cover at least a substantial part of the existing external surface of the wall;

mounting each surface panel to one or more of the support elements, so that cavities are defined between the internal wall-facing surfaces of the panels and the existing external surface of the wall; and supplying flowable insulation material into the cavities;

wherein the step of mounting the support elements to the external surface comprises:

positioning a spacer between each support element and the external surface of the wall, wherein the spacer is hollow, adjustable and one-piece, the spacer comprising:

a first end adapted to abut the external surface of the wall;

a second end adapted to abut the support element;

a main axis extending in a direction between the first and second ends;

a first mounting face which is at a first distance from the first end of the spacer; and a second mounting face which is at a second distance from the first end of the spacer, the second distance being greater than the first distance;

and adjusting the spacer between a first configuration wherein the first mounting face abuts the support element, and a second configuration wherein the second mounting face abuts the support element, by rotating the spacer relative to the support element about the main axis, to vary a space between the support element and the external surface of the wall.

28. A retro-fit external insulation system for a building, the system comprising:

a plurality of support elements, the support elements being mountable to an existing external surface of a wall of a building;

a plurality of surface panels, each of which comprises an internal wall-facing surface and an external surface; and a flowable insulation material;

wherein the plurality of surface panels are adapted to cover at least a substantial part of the existing external surface of the wall;

wherein the surface panels are each adapted to be mounted to one or more of the support elements, so that cavities are defined between the internal wall-facing surfaces of the panels and the existing external surface of the wall, into which the flowable insulation material can be supplied;

and wherein the system further comprises a plurality of spacers, each spacer of the plurality of spacers being hollow, adjustable, one-piece, and adapted to be positioned between a support element and the surface, each spacer of the plurality of spacers comprising:

a first end adapted to abut the surface;

a second end adapted to abut the support element;

a main axis extending in a direction between the first and second ends;

a first mounting face which is at a first distance from the first end of the spacer; and a second mounting face which is at a second distance from the first end of the spacer, the second distance being greater than the first distance;

in which each spacer of the plurality of spacers is adjustable between a first configuration in which the first mounting face abuts the support element, and a second configuration in which the second mounting face abuts the support element, by rotation relative to the support element about the main axis, to vary a space between the support element and the surface.

* * * * *